US005582459A

United States Patent [19]

Hama et al.

[11] Patent Number: 5,582,459

[45] Date of Patent: Dec. 10, 1996

[54] CHAIR HAVING TILTABLE SEAT BACK

[75] Inventors: Katsunori Hama; Hiroshi Iwabuchi; Shunichi Takamatsu, all of Osaka; Masaru Nakaseko, Mukoh, all of Japan

[73] Assignee: Itoki Crebio Corporation, Osaka, Japan

[21] Appl. No.: 316,356

[22] Filed: Sep. 29, 1994

[30] Foreign Application Priority Data

| | | | |
|---|---|---|---|
| Sep. 30, 1993 | [JP] | Japan | 5-245663 |
| Sep. 30, 1993 | [JP] | Japan | 5-245664 |
| Sep. 30, 1993 | [JP] | Japan | 5-245665 |
| Dec. 10, 1993 | [JP] | Japan | 5-310274 |

[51] Int. Cl.[6] ..... A47C 3/00

[52] U.S. Cl. ..... 297/300.2; 297/285

[58] Field of Search ..... 297/285, 300.1, 297/300.2, 300.5, 300.6, 354.1, 316, 313, 322, 340, 354.1, 284.1, 284.4

[56] References Cited

U.S. PATENT DOCUMENTS

| | | | |
|---|---|---|---|
| 4,157,203 | 6/1979 | Ambasz | 297/300.5 |
| 4,685,733 | 8/1987 | Machate et al. | 297/284 |
| 4,758,045 | 7/1988 | Edel et al. | 297/300.2 |
| 5,108,149 | 4/1992 | Ambasz | 297/300.5 X |
| 5,308,144 | 5/1994 | Korn | 297/300.2 |

FOREIGN PATENT DOCUMENTS

| | | |
|---|---|---|
| 245012 | 2/1990 | Japan . |
| 246811 | 2/1990 | Japan . |
| 458905 | 2/1992 | Japan . |

*Primary Examiner*—Milton Nelson, Jr.

*Attorney, Agent, or Firm*—Michael D. Bednarek; Kilpatrick & Cody

[57] ABSTRACT

A chair is provided which comprises a support, a seat arranged above the support, and a seat back tiltably connected to the support behind the seat. The seat back has an upper back supporting portion and a lower waist supporting portion. The chair further comprises a mechanism for deforming the waist supporting portion forward until the seat back tilts rearward to a predetermined intermediate tilt angle but for retarding or stopping such forward deformation when the seat back tilts rearward beyond this intermediate tilt angle. The seat may be made to move rearward as the seat back tilts rearward.

13 Claims, 30 Drawing Sheets

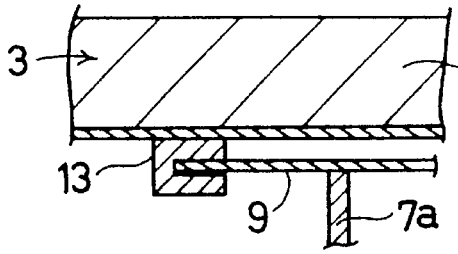
Fig.26
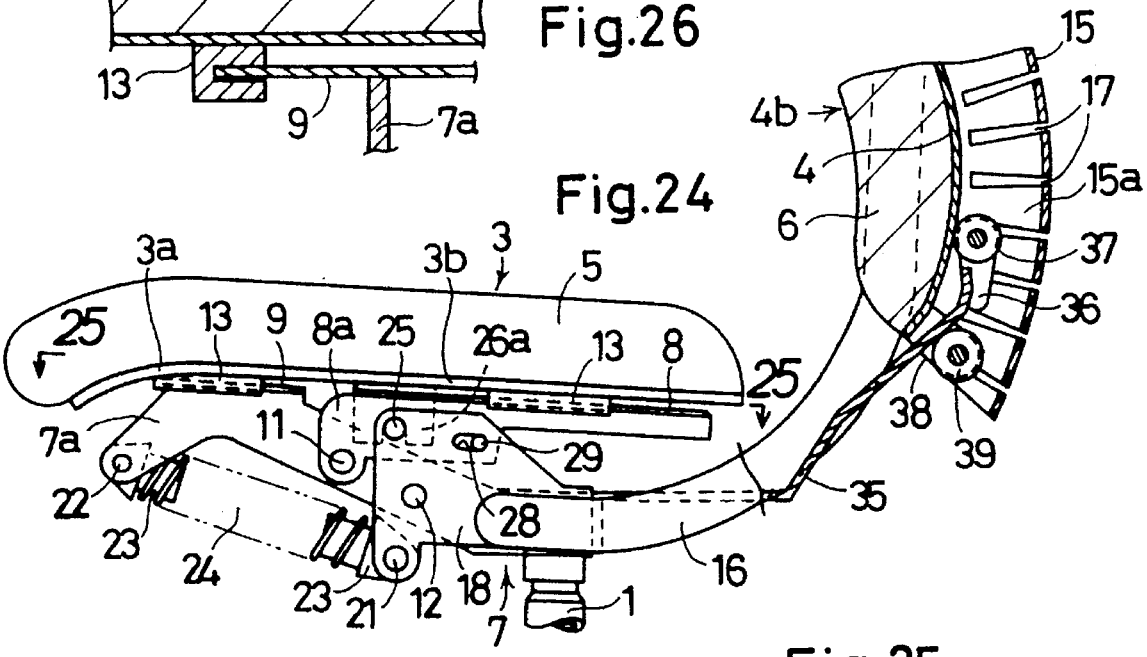
Fig.24
Fig.25
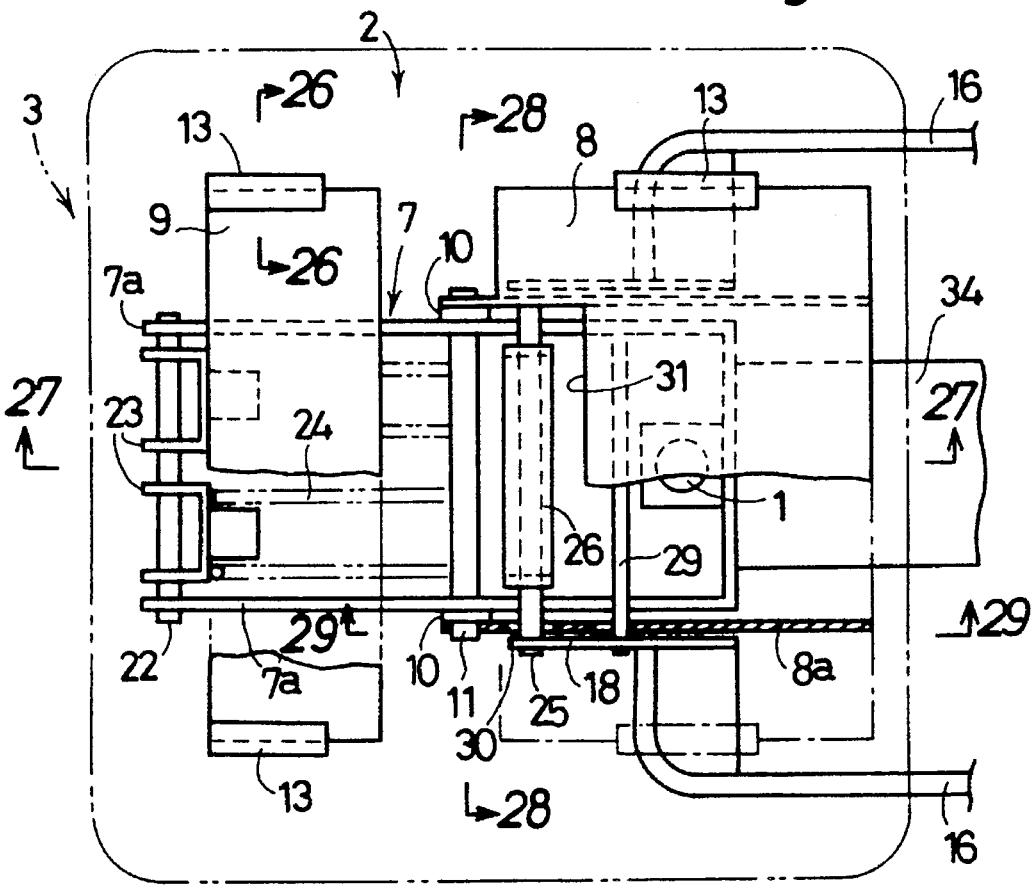

Fig. 34
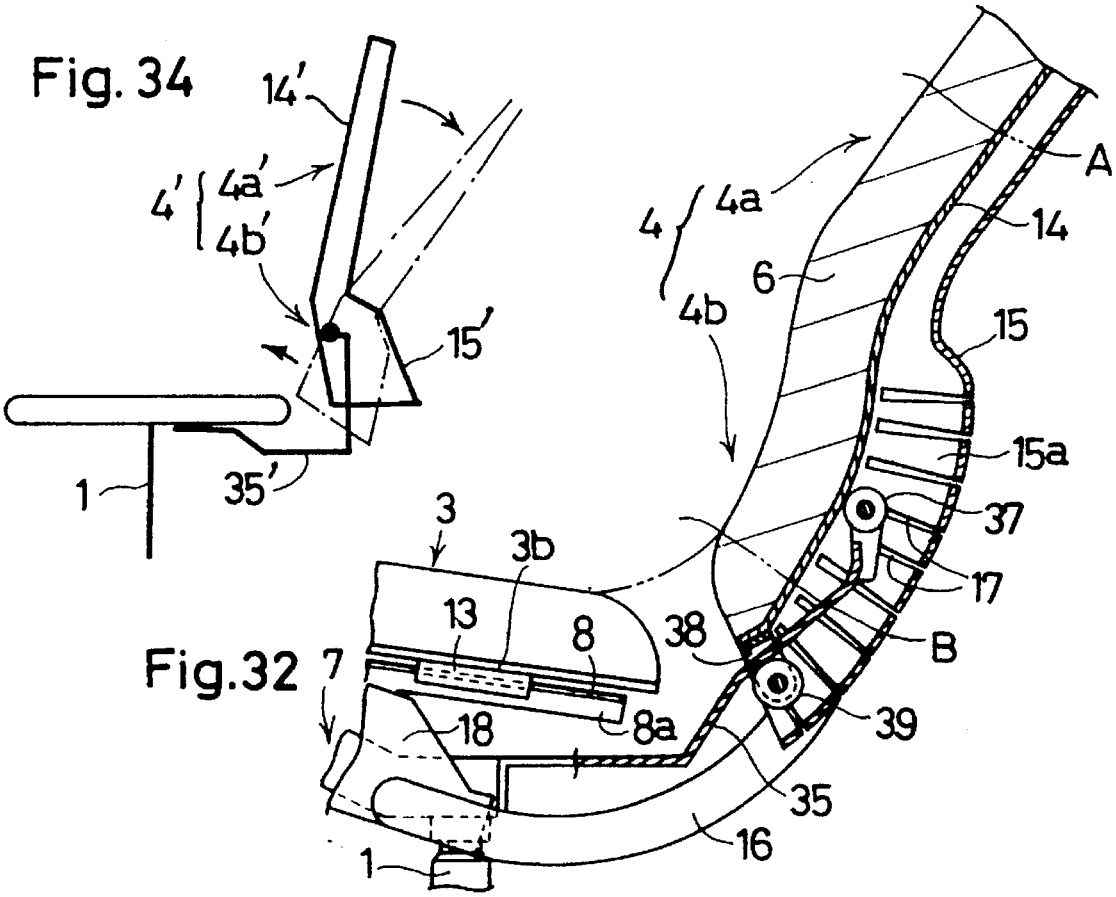
Fig.32
Fig.33
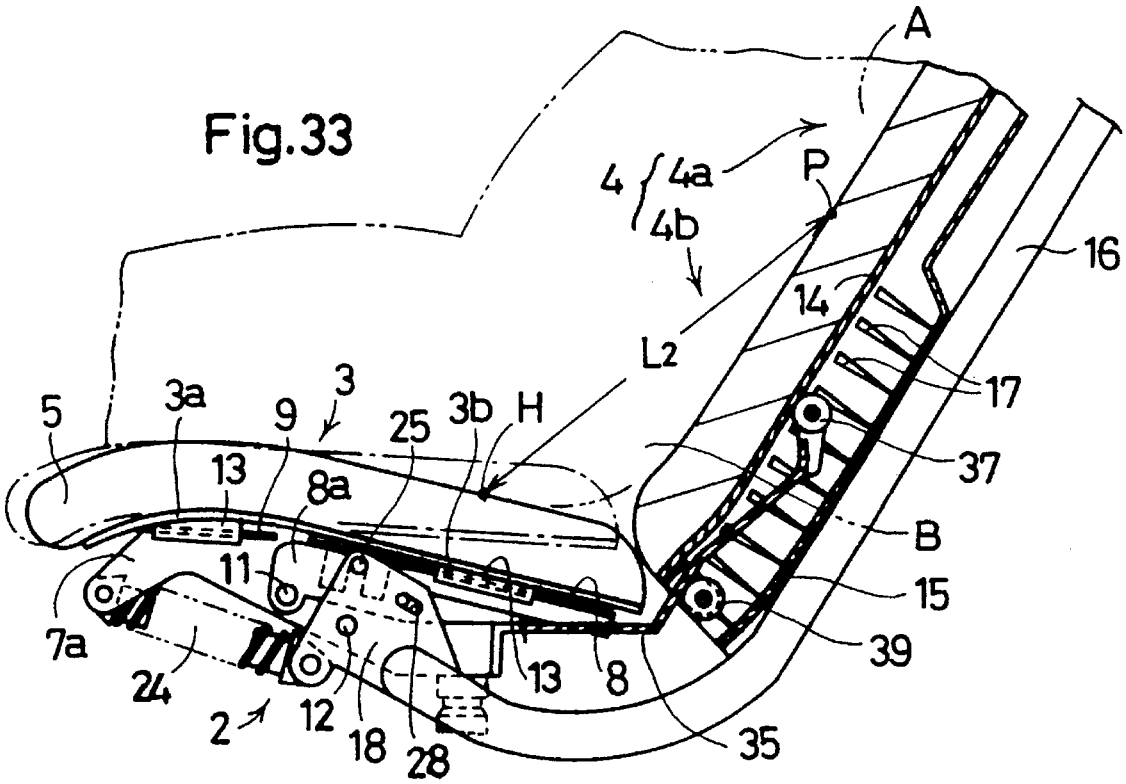

Fig.46a
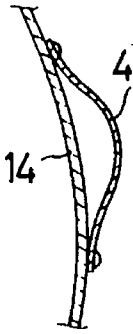
Fig.46b
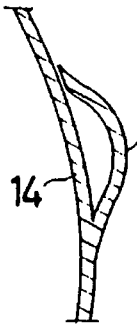
Fig.46c
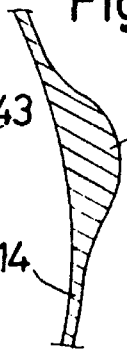
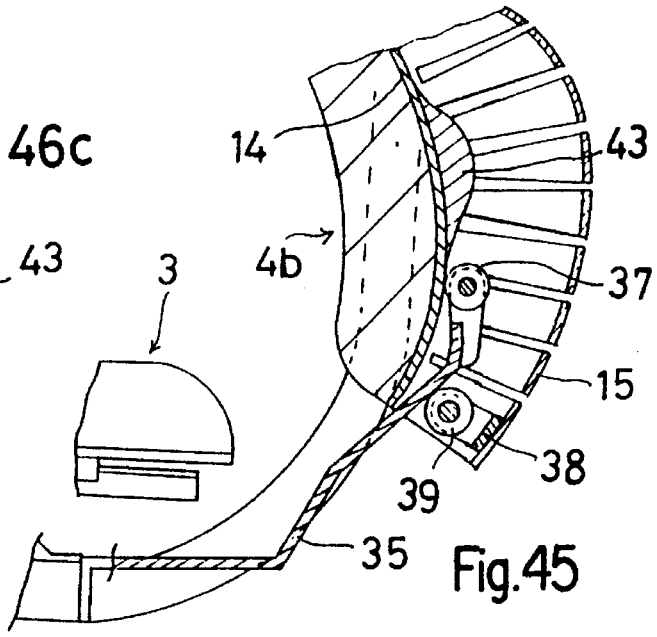
Fig.45
Fig.47
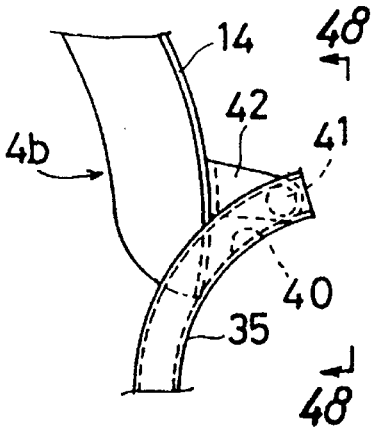
Fig.48
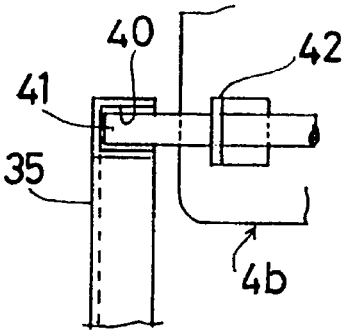
Fig.49a
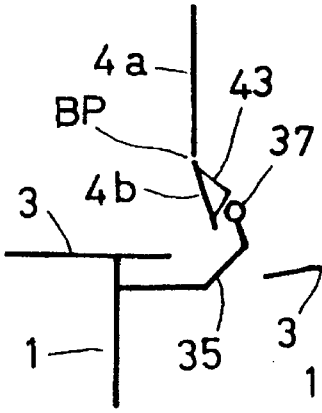
Fig.49b
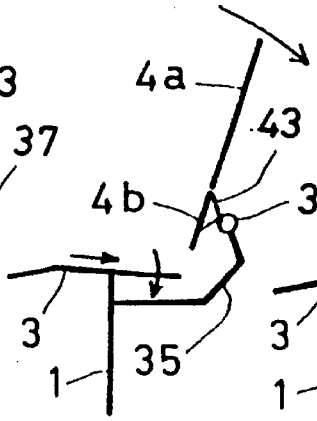
Fig.49c
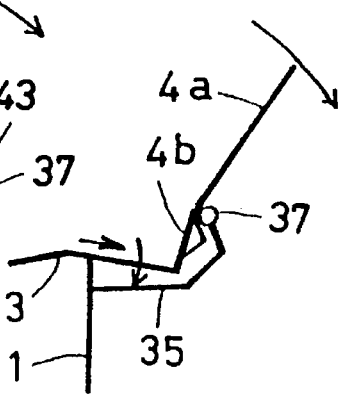

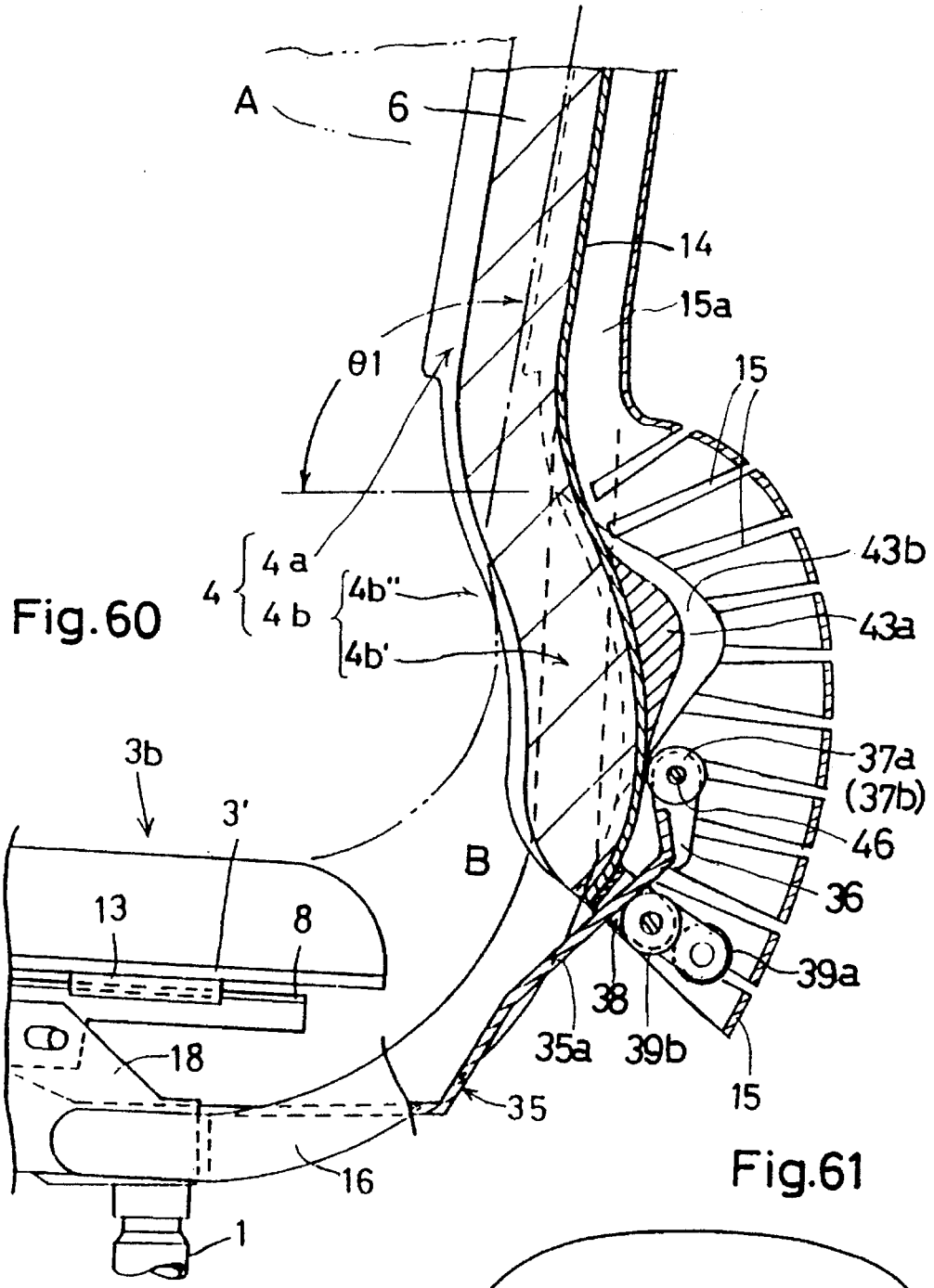
Fig.60
Fig.61
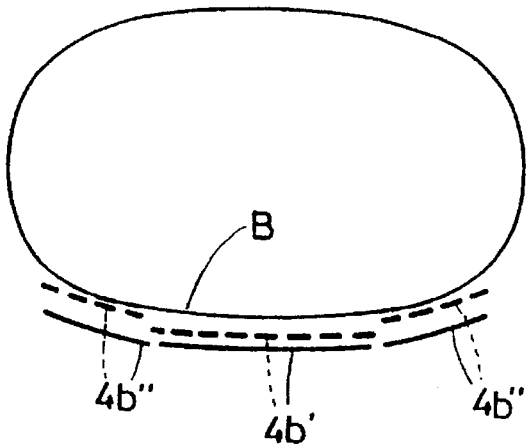

CHAIR HAVING TILTABLE SEAT BACK

BACKGROUND OF THE INVENTION

1. Field of the Invention

This invention relates to a chair of the type which has a rearwardly tiltable seat back.

2. Description of the Related Art

There are various types of chairs which include arm chairs, rocking chairs, and etc. In designing any type of chair, primary attention is given to ensure that the seat occupant is comfortably seated for a long time, taking the human technology into consideration.

U.S. Pat. No. 4,685,733 to Machate et al discloses a rocking chair wherein the seat back has a waist supporting portion which bulges progressively forward as the seat back tilts rearward. If the waist supporting portion of the seat back bulges to a reasonable extent (which is the case when the seat back tilts only halfway), it provides a comfortable support for the seat occupant. However, if the waist supporting portion bulges excessively, the seat occupant feels uncomfortable or uneasy because his or her torso is rearwardly bent sharply at the back. Such a problem often occurs when the seat back tilts fully rearward.

Japanese Patent Application laid-open No. 2-46811 (Laid-open: Feb. 6, 1990) discloses a similar rocking chair.

Japanese Patent Application laid-open No. 2-45012 (laid-open: Feb. 15, 1992) discloses a rocking chair wherein the seat back has a waist supporting portion which bulges progressively forward upon tilting of the seat back, and wherein the seat is made to translationally move forward as the seat back tilts forward. In addition to the disadvantage discussed above, this chair has been found to have another disadvantage that the clothing (e.g. shirt) of the seat occupant is pulled as the seat moves translationally forward.

Japanese Patent Application laid-open No. 4-58905 (Laid-open: Feb. 25, 1992) also discloses a rocking chair which is similar to that disclosed in Japanese Patent Application laid-open No. 4-45012 discussed above.

SUMMARY OF THE INVENTION

It is, therefore, an object of the present invention to provide a chair having a rearwardly tiltable seat back which is capable of providing a comfortable reclining or rocking throughout the entire tilting range.

Another object of the present invention is provide a chair having a rearwardly tiltable seat back wherein the clothing of the seat occupant is prevented from being pulled upon reclining on the seat back.

According to one aspect of the present invention, there is provided a chair comprising: a support structure; a seat supported on the support structure; a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind, the control means being tiltable rearward; wherein the chair further comprises means for preventing the control means from tilting rearward until the seat back tilts rearward up to a predetermined intermediate inclination angle but for allowing the control means to tilt rearward when the seat back tilts rearward beyond the predetermined intermediate inclination angle.

Throughout the specification, the term "waist" is intended to include both the waist and hips of the seat occupant.

According to another aspect of the present invention, there is provided a chair comprising: a support structure; a seat supported on the support structure; and a seat back located behind the seat for tilting rearward against elastic means; wherein the chair further comprises means for causing the seat to move rearward in response to rearward tilting of the seat back.

The seat back may comprise an upper back supporting portion which is substantially non-deformable, and a lower waist supporting portion which is elastically deformable. Further, the chair additionally comprise control means for pressing the waist supporting portion of the seat back forward when the seat back tilts rearward.

Preferably, the waist supporting portion of the seat back is forwardly concave to retreat rearward from the back supporting portion before the seat back tilts rearward, and the control means presses the waist supporting portion forward to straighten it when the seat back tilts rearward. Further, the seat back may comprise a downwardly open shell which includes an inner shell plate and an outer shell plate joined to the inner shell plate. In this case, the control means is made to extend into the shell from below for pressing contact with the waist supporting portion.

According to a further aspect of the present invention, there is provided a chair comprising: a support structure; a seat supported on the support structure; a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind; wherein the chair further comprises means for causing the control means to deform the waist supporting portion of the seat back forward relative to the back supporting portion when the seat back tilts rearward at least up to a predetermined intermediate inclination angle but for restraining forward deformation of the waist supporting portion when the seat back tilts rearward beyond the predetermined intermediate inclination angle.

According to a preferred embodiment, the waist supporting portion of the seat back is forwardly concave to retreat rearward from the back supporting portion before the seat back tilts rearward, the control means extending along the waist supporting portion and having an upper end provided with at least one pressing roller in contact with the waist supporting portion from behind, the waist supporting portion being provided with at least one regulating roller for contact with the control means to prevent the waist supporting portion from excessively deforming forward relative to the back supporting portion, the waist supporting portion further being provided with at least one cam bulge for contact with the pressing roller. As a result, the waist supporting portion of the seat back quickly deforms forward relative to the back supporting portion until the seat back tilts rearward up to the predetermined intermediate inclination angle, whereas forward deformation of the waist supporting portion is at least retarded when the seat back tilts rearward beyond the predetermined intermediate inclination angle.

The control means may be in the form of a control plate fixed to the support structure.

According to still another aspect of the present invention, there is provided a chair comprising: a support structure; a seat supported on the support structure; a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind; wherein the chair further comprises means for causing the control means to deform the waist supporting portion of the seat back forward relative to the back supporting portion by a greater amount at widthwise outer positions of the waist supporting portion than at a widthwise inner position when the seat back tilts rearward.

Other objects, features and advantages of the present invention will be fully understood from the following detailed description given with reference to the accompanying drawings.

BRIEF DESCRIPTION OF THE DRAWINGS

In the accompanying drawings:

FIGS. 17*a* and 17*b* are illustrative views showing why and how a seat occupant is comfortably seated;

FIG. 24 is a side view similar to FIG. 20 but showing the same chair in a somewhat enlarged scale partly in section;

FIG. 25 is a sectional plan view taken along lines 25—25 in FIG. 24;

FIG. 26 is a sectional view taken along lines 26—26 in FIG. 25;

FIG. 32 is a fragmentary side view similar to FIG. 31 but showing the same chair with the seat back tilted halfway;

FIG. 33 is a fragmentary side view similar to FIG. 31 but showing the same chair with the seat back tilted fully;

FIG. 34 is a schematic side view showing a typical prior art chair;

FIG. 45 is a fragmentary side view showing a principal portion of a chair according to a tenth embodiment of the present invention;

FIGS. 46*a* through 46*c* are fragmentary sectional views showing three different modifications of the ninth embodiment;

FIG. 47 is a fragmentary side view showing a principal portion of a chair according to an eleventh embodiment of the present invention;

FIG. 48 is a fragmentary rear view as seen in the direction of arrows 48—48 in FIG. 47;

FIGS. 49*a* through 49*c* are schematic side views showing a chair according to a twelfth embodiment of the present invention different tilting states;

FIG. 60 is a sectional view taken along lines 60—60 in FIG. 53;

FIG. 61 is a schematic plan view showing the seat back of the chair according to the thirteen embodiment in relation to the seat occupant;

FIG. 78 is a side view showing a prior art chair with the seat occupant.

DETAILED DESCRIPTION OF THE PREFERRED EMBODIMENTS

Figure 2:
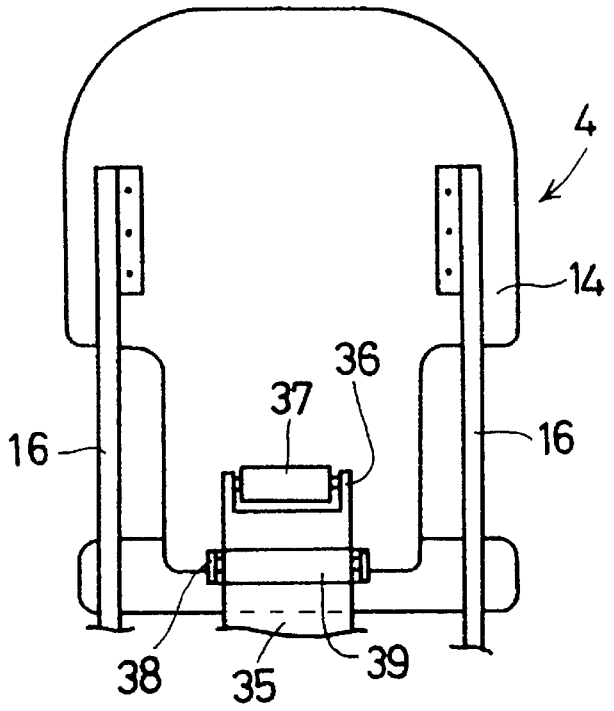
FIG. 2 is a rear view, partly cut away, showing the same chair.

Various embodiments of the present invention are described below with reference to the accompanying drawings.

(1) Embodiment 1 (FIGS. 1–16):

FIGS. 1 through 16 show a chair according to a first embodiment of the present invention.

The chair of the first embodiment comprises a leg post 1 stably supported on a floor surface (not shown), a seat carrier 2 mounted to the upper end of the leg post 1, a seat 3 carried by the seat carrier 2, and a seat back 4 mounted to the seat carrier 2. The seat 3 has a cushion 5 on its upper side. Similarly, the back a also has a cushion 6 on its front side.

As shown in FIGS. 4 through 12, the seat carrier 2 includes a stationary frame 7 fixed to the upper end of the leg post 1, and a movable carrier plate 8 arranged above the frame 7. The carrier plate 8 is slightly narrower than the seat 3.

Figure 4:
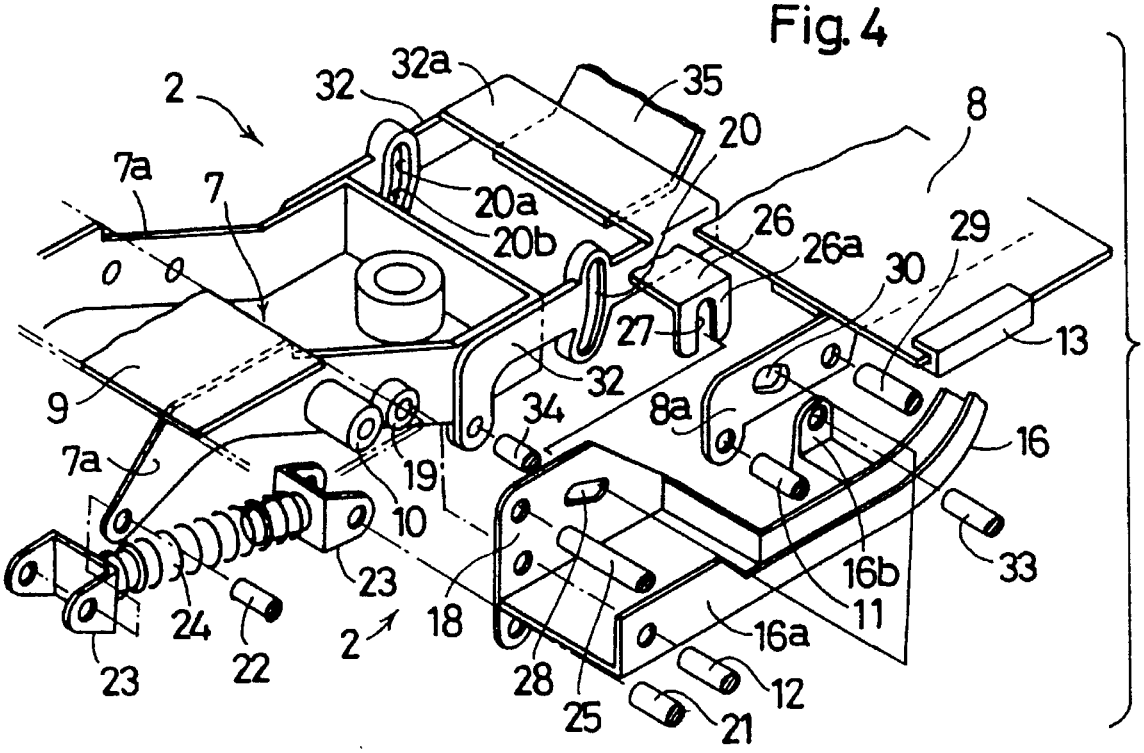
FIG. 4 is an exploded perspective view showing a portion of the same chair.
Figure 5:
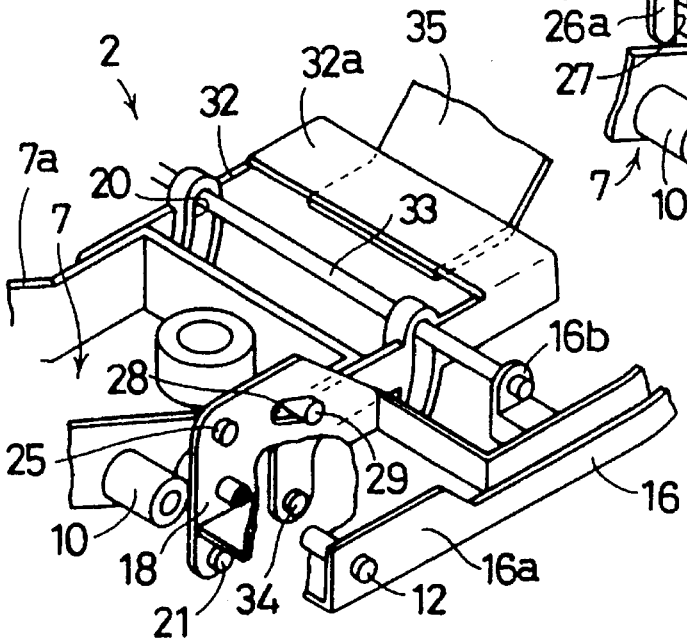
FIGS. 5 through 7 are fragmentary perspective views showing a stationary frame of the same chair together with its related parts.

As clearly shown in FIG. 4, the stationary frame 7 is upwardly open and has a pair of side walls 7*a*. The stationary frame 7 has a front portion obliquely extending forwardly upward, but the side walls 7*a* further have respective forward extentions obliquely extending forwardly downward. On top of the front portion of the stationary frame 7 is attached a stationary carrier plate 9 which is equal in width to the movable carrier plate 8.

Figure 6:
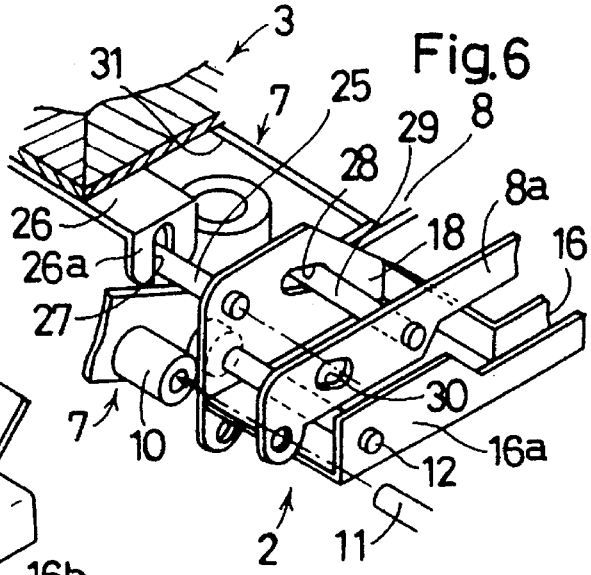
Figure 7:
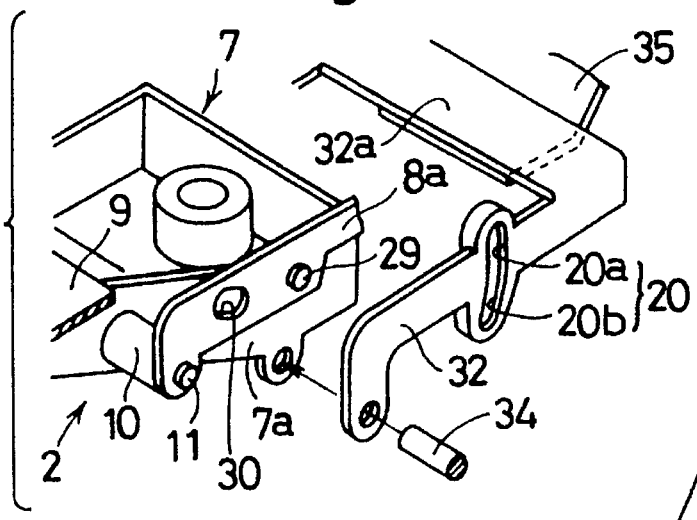
Figure 9:
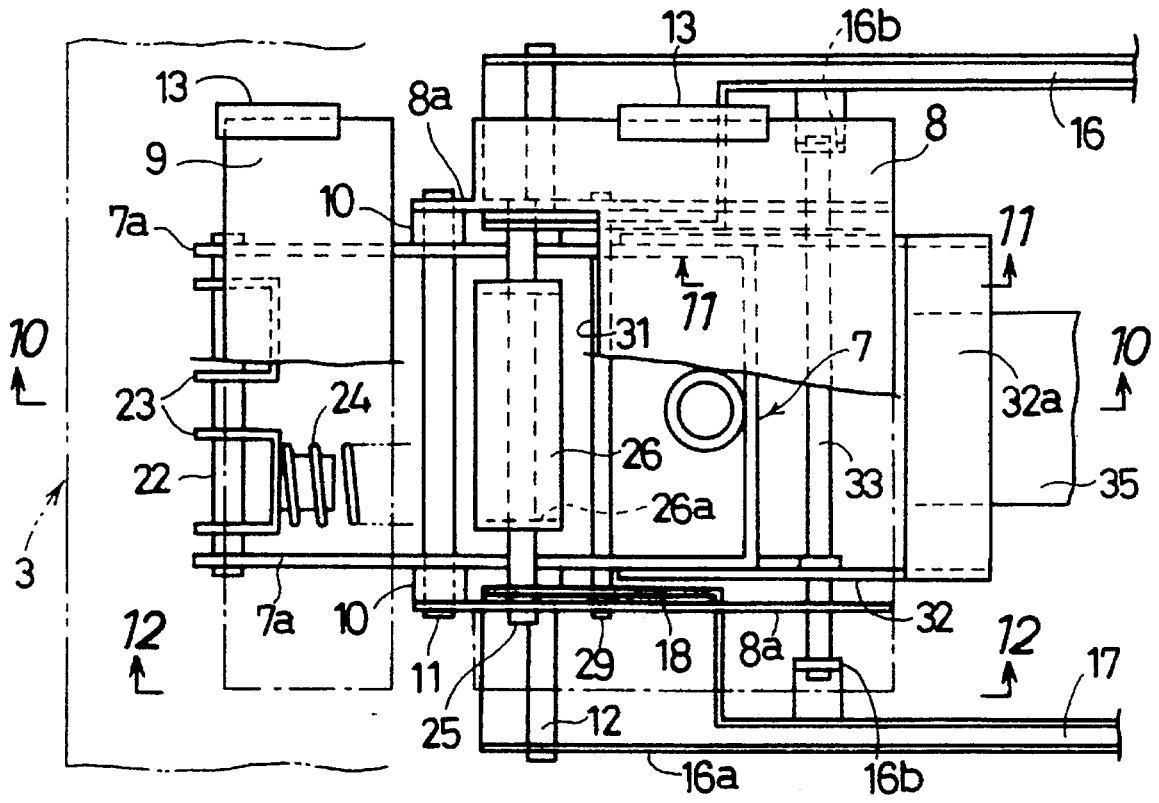
FIG. 9 is a plan view of the same chair as seen in the direction of arrows 9—9 in FIG. 1.
Figure 10:
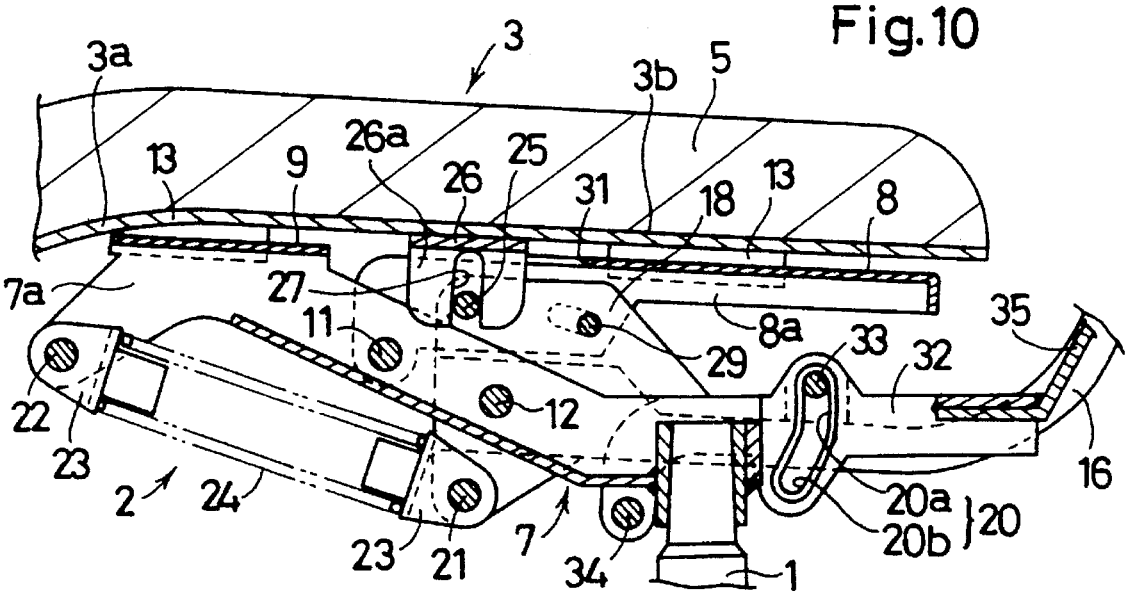
FIG. 10 is a sectional view taken on lines 10—10 in FIG. 9.
Figure 11:
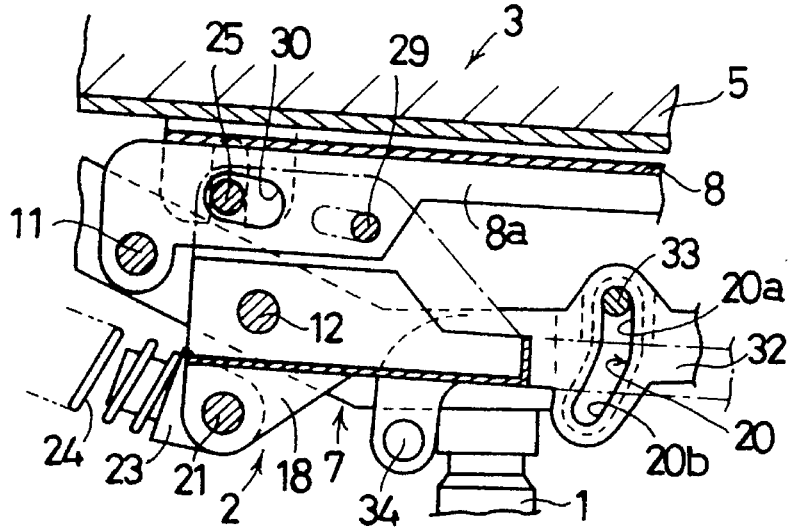
FIG. 11 is a sectional view taken on lines 11—11 in FIG. 9.
Figure 12:
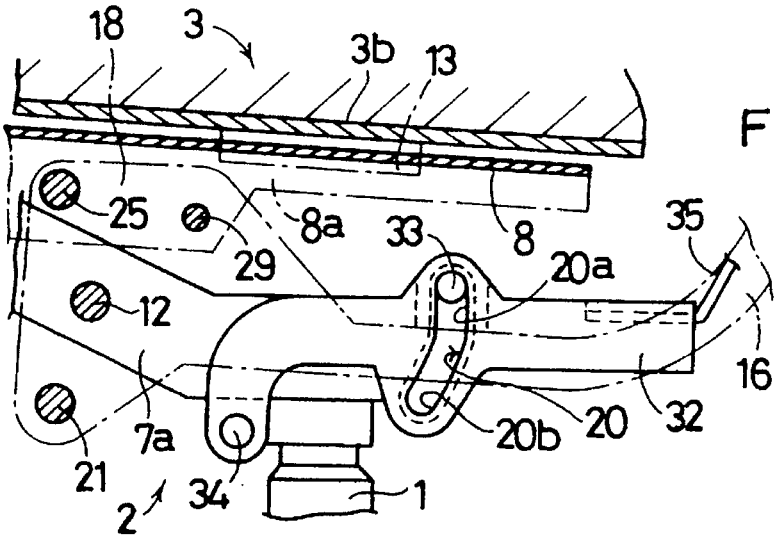
FIG. 12 is a sectional view taken on lines 12-13 12 in FIG. 9.

As shown in FIGS. 4, 6 and 9, the underside of the movable carrier plate 8 is fixedly provided with a pair of downward brackets 8*a* extending along both side walls 7*a* of the stationary frame 7. Each of the downward brackets 8*a* has a forward end pivotally connected, by a first pivot shaft 11, to a first bearing 10 which is fixed to each side wall 7*a* of the stationary frame 7.

As shown in FIGS. 1, 3, 4 and 9, the seat 3 has a front portion 3*a* supported on the stationary carrier plate 9, and a rear portion 3*b* supported on the movable carrier plate 8. The underside of the seat 3 is fixedly provided with sliders 13 (two at the front portion 3*a* and two at the rear portion 3*b*) slidably fitting to respective side edges of the movable and stationary carrier plates 8, 9. Thus, the seat 3 is movable generally horizontally back and forth as well as pivotable rearwardly downward. Further, the seat 3 is also bendable at a position between the front portion 3*a* and the rear portion 3*b*.

Figure 1:
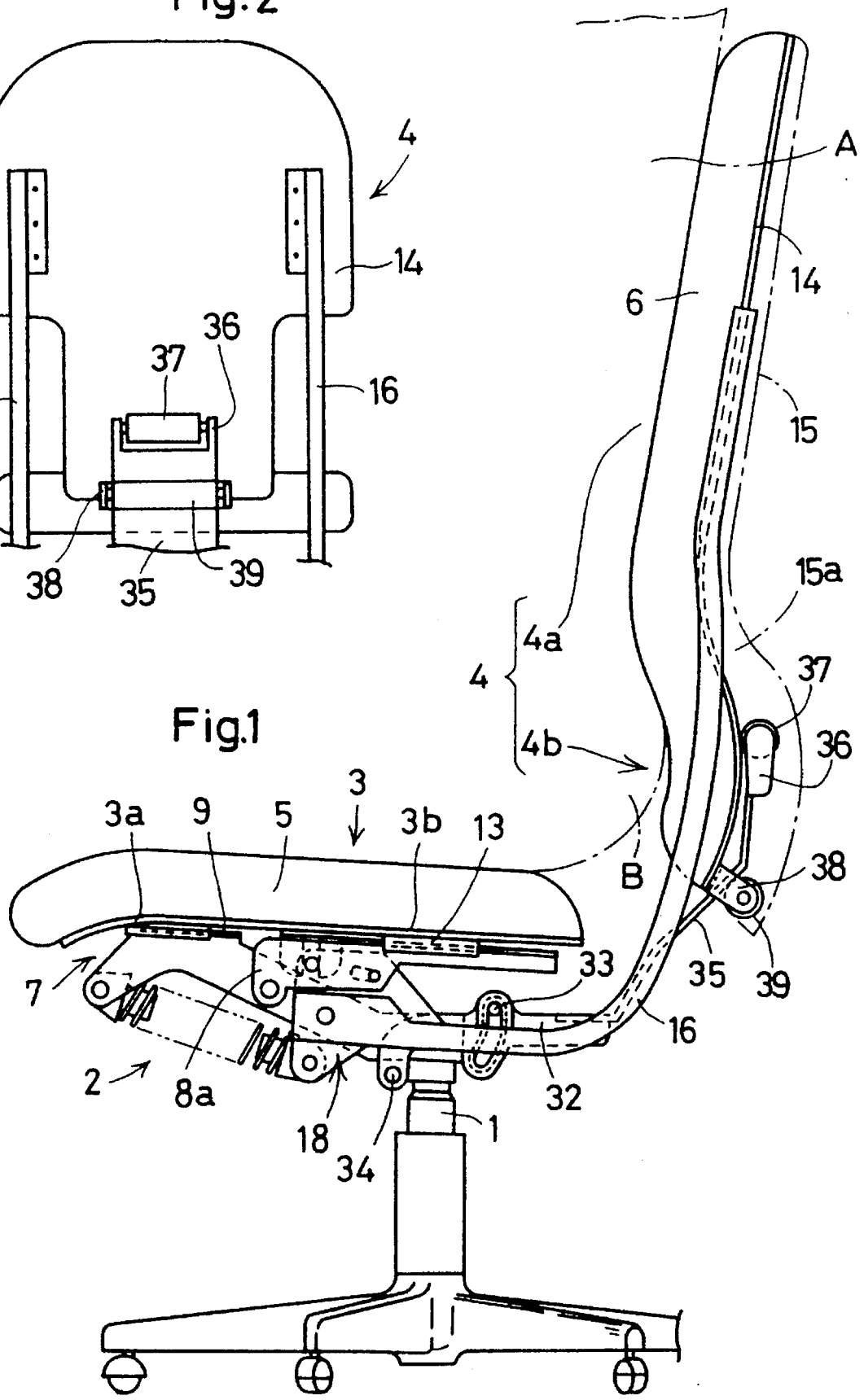
FIG. 1 is a side view showing a chair according to a first embodiment of the present invention.

As shown in FIGS. 1 and 2, the seat back 4 has a wider back supporting portion 4*a* for supporting the user's back A, and a narrower waist supporting portion 4*b* continuous with the back supporting portion 4*a* for supporting the user's waist B (including the user's hips as previously defined). The back supporting portion 4*a* is generally flat, whereas the waist supporting portion 4*b* is rendered forwardly concave. In the absence of any reclining load, the back supporting portion 4*a* is inclined at an angle of 100° relative to a horizontal plane.

As also shown in FIGS. 1 and 2, the seat back 4 comprises an inner shell plate 14 and an outer shell plate 15. The outer shell plate 15 has side walls 15*a* for joining to the inner shell plate 14 by screwing for example. Thus, the inner and outer shell plates 14, 15 together consititute a hollow shell which is downwardly open. Both shell plates 14, 15 may be equally made of a synthetic resin.

A pair of generally L-shaped seat back supporting arms are fixedly connected, at their respective upper ends, to the rear surface of the inner shell plate 14 at both sides thereof by screwing for example. It should be appreciated that the outer shell plate 15 is omitted in FIG. 2 to show the interior of the shell.

Figure 20:
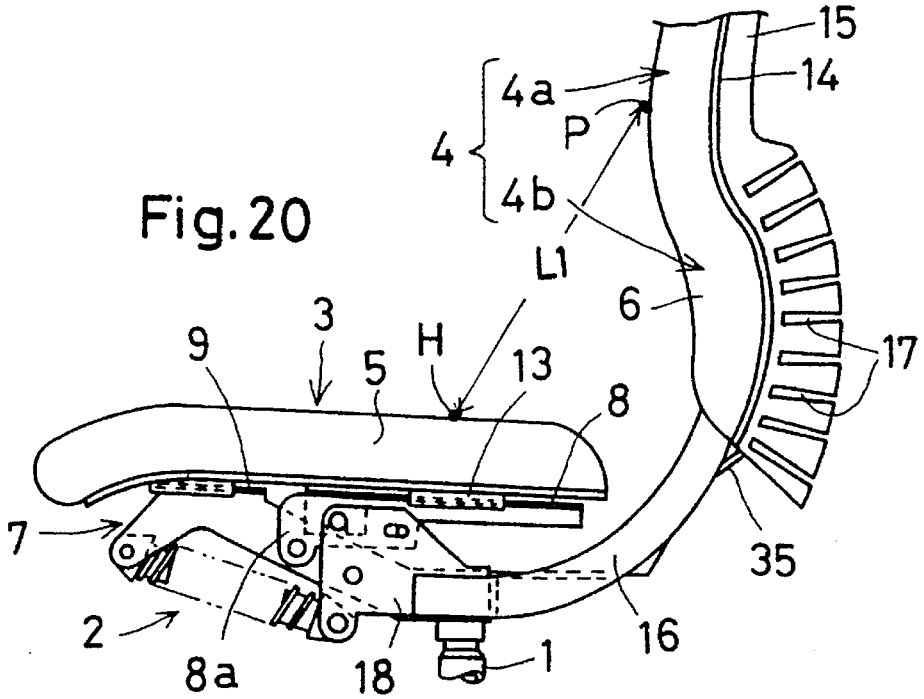
FIG. 20 is a fragmentary side view showing a principal portion of a chair according to a third embodiment of the present invention.
Figure 21:
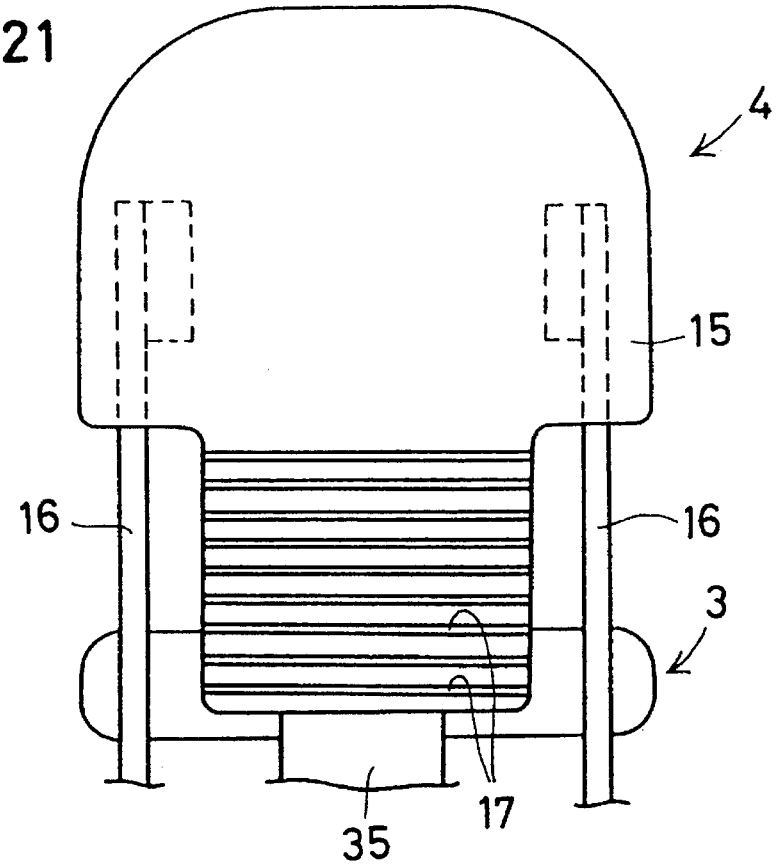
FIG. 21 is a rear view of the chair shown in FIG. 20.

Due to the rigidity provided by the side walls 15*a* of the outer shell plate 15, the back supporting portion 4*a* of the seat back 4 is substantially prevented from elastic deformation. Conversely, the waist supporting portion 4*b* of the seat back 4 is rendered elastically flexible by forming a plurality of rearwardly open slits (see elements 17 in FIG. 20 illustrating a different embodiment) at a portion of the outer shell plate 15 corresponding to the waist supporting portion As shown in FIGS. 4–6, 9 and 10, a mounting plate 18 is fixed to the lower forward end 16*a* of each seat back supporting arm 16 between a corresponding side wall 7*a* of the stationary frame 17 and a corresponding downward bracket 8*a* of the movable carrier plate 8. A second bearing 19 (see FIG. 4) is attached to the side wall 7*a* of the stationary frame 7 slightly behind the first bearing 10, and the mounting plate 18 has a vertically intermediate portion pivotally connected to the side wall 7*a* of the stationary frame 7 by means of a second pivot shaft 12 fitted into the second bearing 19.

As shown in FIGS. 3, 4, 9 and 10, a first support shaft 21 extends from a lower end portion of the mounting plate 18 of one seat back supporting arm 16 to a lower end portion of the mounting plate 18 to the other seat back supporting arm 16. Furthers a second support shaft 22 extends between the respective side walls 7*a* of the stationary frame 7. Two pairs of spring seats 23 are fitted on the first and second support shafts 21, 22, and tilting control coil springs 22 are interposed under compression between the respective pairs of spring seats 23. The coil springs 22 provide a means for elastically supporting the seat back 4.

As clearly shown in FIG. 4, the first bearing 10 for the first pivot shaft 11 laterally projects to a greater extent than the second bearing 19 for the second pivot shaft 12. Due to such an arrangement, the mounting plate 18 of each seat back supporting arm 16 can pivot rearwardly downward without interfering with the movable carrier plate 8.

As shown in FIGS. 6 and 9–11, the respective mounting plates 18 of the seat back supporting arms 16 project upwardly beyond the stationary frame 7 and carry a third support shaft 25 therebetween. The underside of the seat 3 is fixedly provided, immediately above the third support shaft 25, with an engaging member 26 having a pair of end flanges 26*a*. Each of the end flanges 26*a* has an engaging groove 27 which is downwardly open.

As shown in FIGS. 3, 4, 6 and 9, each mounting plate 18 is formed with an elongated oblique guide slot 28 extending rearwardly downward. A guide shaft 29 extends between the respective downward brackets 8*a* of the movable carrier plate 8 and penetrates through the guide slot 28.

Each downward bracket 8*a* of the movable carrier plate 8 is further provided with an escaping slot 30 (see FIGS. 3 and 6) in which is fitted the third support shaft 25 carried by the respective mounting plates 18 of the seat back supporting arms 16. The escaping slot 30 allows movement of the third support shaft 25 relative to the downward bracket 8*a* (namely, the movable carrier plate 8), thereby allowing pivoting of each seat back supporting arms 16 about the second pivot shaft 12.

Further, a front portion of the movable carrier plate 8 is formed with a cutout 31 (see FIGS. 9 and 10) in which the end flanges 26*a* of the engaging member 26 are positioned. Thus, the seat 3 is allowed to move horizontally with the engaging member 26.

When the seat back support arms 16 pivot rearwardly downward, the third support shaft 25 fitting in the engaging grooves 27 of the engaging member 26 pivots rearward about the second pivot shaft 12 while the movable carrier plate 8 moves downward under the rearwardly shifted weight of the seat occupant. Thus, the seat 3 is inclined rearwardly downward as guided by the combination of the oblique guide slots 28 and the guide shaft 29 while slidably moving rearward as guided by the sliders 13. At this time, the front portion 3*a* of the seat 3 slidably moves only horizontally due to the guiding function provided by the stationary carrier plate 9.

As shown in FIGS. 1, 3, 4 and 7, a pivotal frame 32 has a front end portion pivotally connected to the side walls 7*a* of the stationary frame 7 by a fourth pivot shaft 32. The pivotal frame 32 has a rear connecting web portion 32*a* connected to a metallic control plate 35 extending rearwardly upwardly into the interior of the shell defined by the combination of the inner and outer shell plates 14, 15 (see FIG. 1). The control plate 35 has an upper rear end integrally formed with a pair of side flanges 36 for rotatably supporting a pressing roller in pressing contact with the inner shell plate 14 (see FIGS. 2, 8 and 13).

Figure 8:
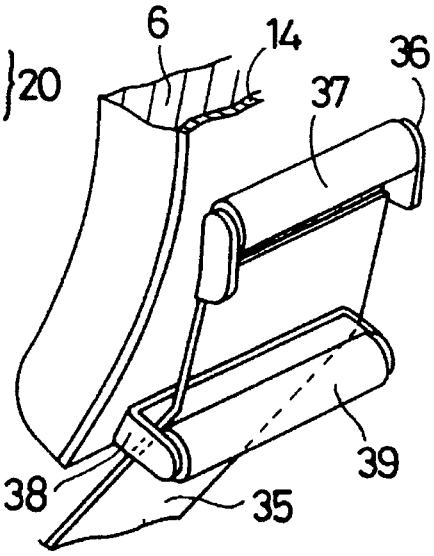
FIG. 8 is a fragmentary perspective view showing the seat back of the same chair.

As best shown in FIG. 8, the lower end of the inner shell plate 14 is provided with a pair of rearwardly directed mounting brackets 38 for rotatably supporting a regulating roller 39. The control plate 35 includes a steeply inclined lower portion 35*a* and a gently inclined intermediate portion 35*b*, as shown in FIG. 3.

As shown in FIGS. 3, 5, 7 and 10, the pivotal frame 32 is intermediately provided with a pair of elongate guide slots 20 in which a follower shaft 33 is slidably fitted. The follower shaft 33 is connected at both ends to the respective seat back supporting arms 16 via respective brackets 16*b*.

Figure 14:
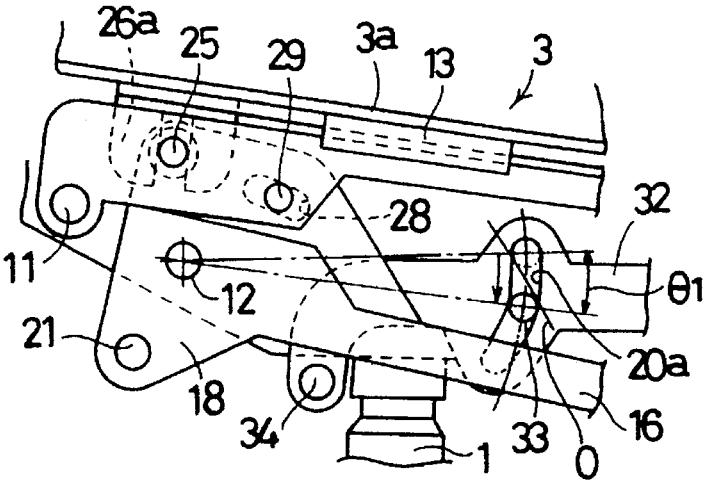
FIGS. 14 and 15 are fragmentary side views showing the operating principle of the same chair.
Figure 15:
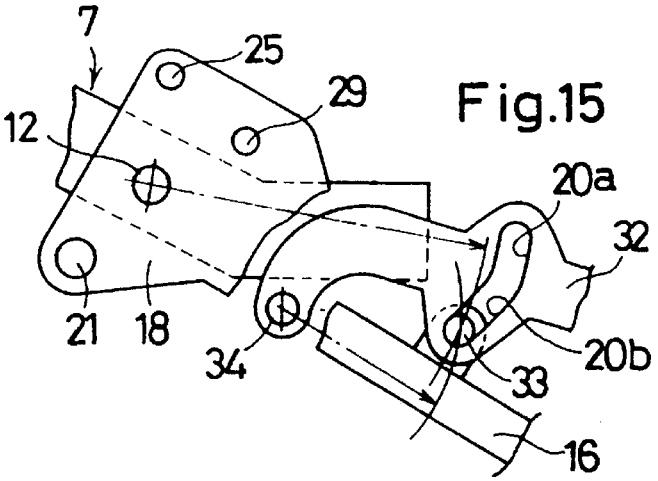

As shown in FIGS. 14 and 15, each of the guide slots 20 has an upper slot portion 20*a* and a lower slot portion 20*b*. The upper slot portion 20*a* extends along an arc which is centered about the second pivot shaft 12. The lower slot portion 20*b* also extends along an arc but is inclined somewhat rearwardly relative to the upper slot portion 20*a*.

Figure 3:
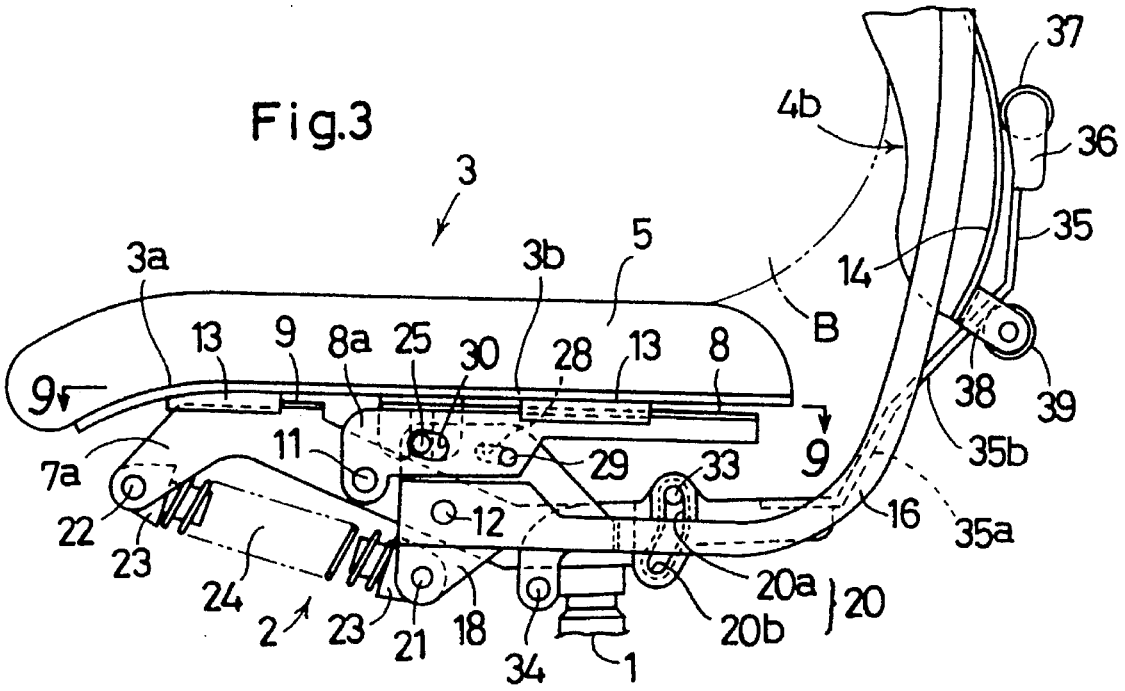
FIG. 3 is fragmentary side view showing a portion of the same chair.

With the arrangement described above, when the user sits on the seat 3 with the torso held substantially upright, the waist supporting portion 4*b* of the seat back 4 which is forwardly concave conveniently supports the waist B of the user near at the root portion of the vertebral column, as shown in FIGS. 1 and 3. Thus, the seat occupant can continue his or her job for a long time without being unduly fatigued.

On the other hand, when the user reclines on the seat back 4, the seat back supporting arms 16 together with the seat back 4 pivot rearwardly downward about the second pivot shaft 12 against the coil springs 24, as shown in FIGS. 13–16. At this time, since the upper arcuate slot portion 20*a* of each elongate guide slot 20 is centered about the second pivot shaft 12, the follower shaft 33 can move downward along the upper slot portion 20*a*, thereby allowing the seat back supporting arms 16 to pivot downward about the second pivot shaft 12. However, an imaginary pivotal path O (see FIG. 14) of the follower shaft 33 centered about the fourth pivot shaft 34 does not coincide with the actual pivotal path of the follower shaft 33, so that the follower shaft 33 is jammed against the upper slot portion 20*a* if the pivotal frame 32 tends to pivot downward about the fourth pivot shaft 34. As a result, the pivotal frame 32 is retained in its initial position together with the control plate 35 within the angular range Θ1 (FIG. 14) in which the follower shaft 33 moves downward along the upper slot portion 20*a*.

Figure 13:
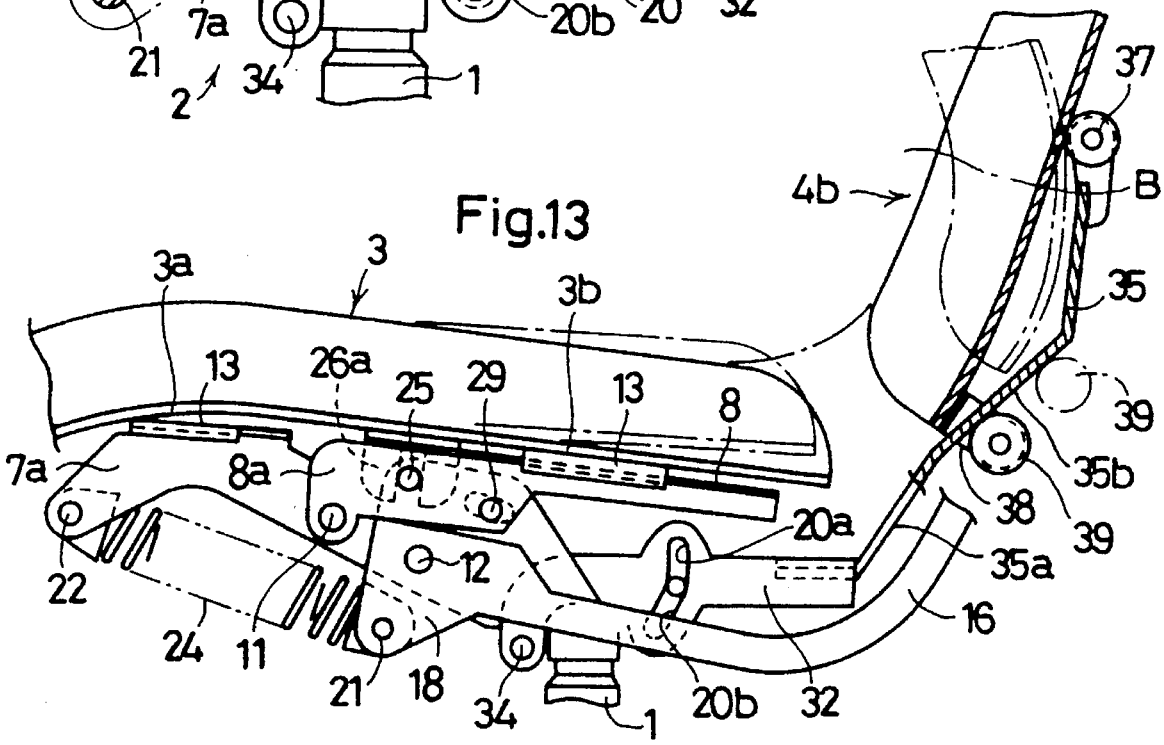
FIG. 13 is a side view similar to FIG. 3 but showing the same chair with its seat back rearwardly tilted halfway.

In such a condition, the waist supporting portion 4b of the rearwardly tilting seat back 4 moves downward with the regulating roller 39 rolling down along the gently inclined intermediate portion 35b of the control plate 35 which is prevented from pivoting rearwardly downward, as shown in FIG. 13. Thus, the waist supporting portion 4b is relatively pushed forward by the pressing roller 37 and thereby straightened progressively to support the waist portion B of the seat occupant, as indicated by solid lines in FIG. 13. As a result, substantially the entirety of the seat back 4 is utilized for uniformly supporting the torso (including the waist) of the seat occupant, thereby providing a comfortable support for the user at the time of rocking the chair.

Figure 16:
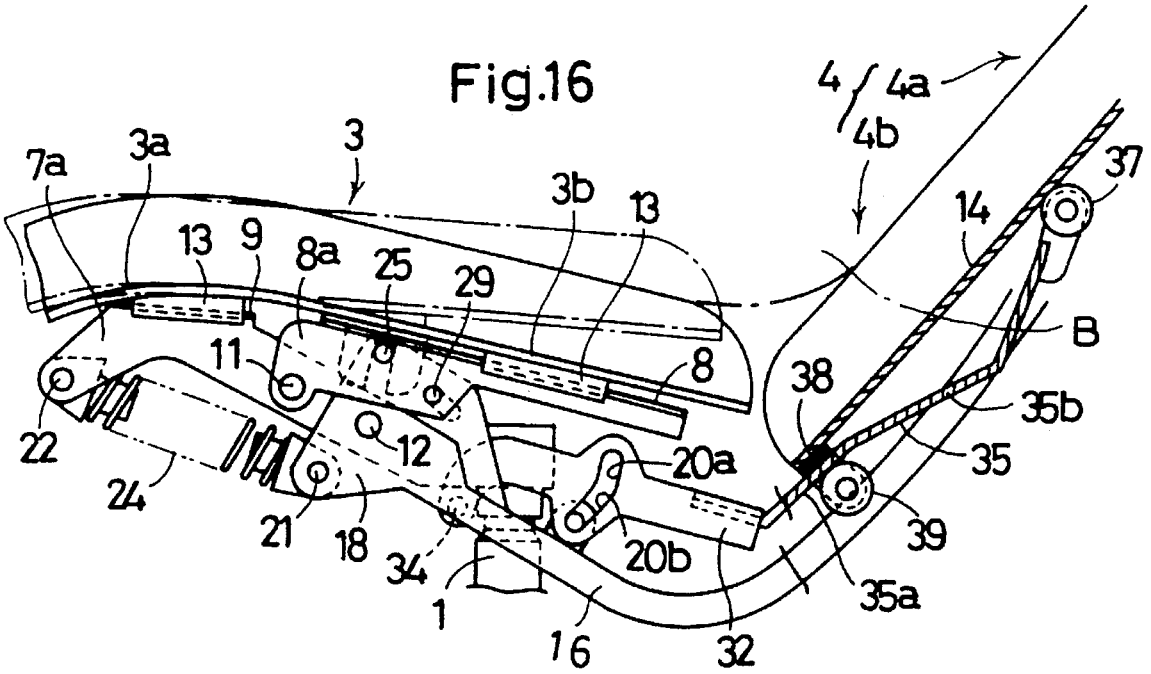
FIG. 16 is a side view similar to FIG. 3 but showing the same chair with its seat back fully tilted.

On the other hand, when the follower shaft 33 reaches the upper end of the lower slot portion 20b of each guide slot 20, the follower shaft 33 presses the pivotal frame 32 downward because the actual pivotal path of the follower shaft 33 does not coincide with the arcuate lower slot portion 20b (see FIG. 14). Thus, upon further downward pivoting of the seat back supporting arms 16, the pivotal frame 32 together with the control plate 35 pivots about the fourth pivot shaft 34 while allowing the follower shaft 33 to slide downward along the lower slot portion 20b, as shown in FIG. 16. As a result, the presser roller 37 is prevented from excessively pushing or forwardly deforming the waist supporting portion 4b of the seat back 4 after the waist supporting portion 4b is substantially straightened, so that the relative position between the back supporting and waist supporting portions 4a, 4b of the seat back 4 changes only little (compare FIGS. 13 and 16).

In summary, the pressing roller 37 acts to forwardly deform the waist supporting portion 4b of the seat back 4 in an accelerated manner until the seat back 4 tilts only up to a predetermined angle at which the follower shaft 33 starts entering into the lower slot portion 20b of each elongate guide slot 20. However, such forward deformation of the waist supporting portion 4b is greatly slowed down or substantially stopped when the seat back 4 tilts beyond the predetermined angle, thereby preventing the waist supporting portion 4b from excessively pushing the waist portion B of the seat occupant.

According to the first embodiment, the elongate guide slot 20 is configured so that the pivotal frame 32 starts pivoting rearwardly downward when the back supporting portion 4a of the seat back 4 is tilted to an inclination angle of about 110° relative to a horizontal plane.

Figure 17A:
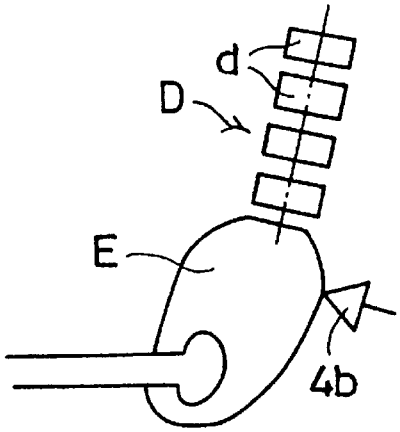
Figure 17A:
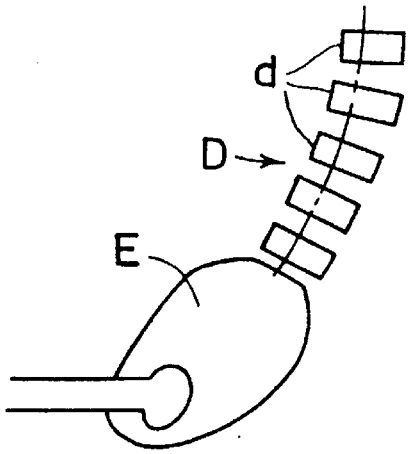

FIGS. 17a and 17b illustrate why a comfortable reclined posture is provided by supporting the waist portion B of the seat occupant.

As shown in FIGS. 17a and 17b, the vertebral column D of a person consists of a plurality of intervertebral disks d, and these disks d together with the pelvis E are supported by the various muscles of the human torso. Further, it is known that the burden or load on the muscles is minimized when all of the intervertebral disks d are held parallel to each other.

If the seat occupant reclines on the seat back 4 (see FIG. 1) in the absence of any support for the pelvis E or waist portion B, the vertebral column D tends to bend in a rearwardly convex form, as shown in FIG. 17b. As a result, the various muscles of the user's torso are increasingly burdened, and therefore the user is fatigued in a short time.

By contrast, if the waist supporting portion 4b of the seat back 4 provides a support for the pelvis E while the seat occupant relies on the seat back 4, the vertebral column d remains substantially straight with the intervertebral disks d held in parallel to each other, as shown in FIG. 17a. Thus, the burden on the muscles of the user's torso is greatly reduced, so that the user is comfortably seated for a long time without feeling much fatigue.

According to the first embodiment, the rear portion 3b of the seat 3 is inclined rearwardly downward under the rearwardly shifted weight of the seat occupant as guided by the combination of the oblique guide slots 28 and the guide shaft 29 while slidably moving rearward as guided by the sliders 13, as previously described. On the other hand, the front portion 3a of the seat 3 slidably moves only horizontally due to the guiding function provided by the stationary carrier plate 9.

Figure 18:
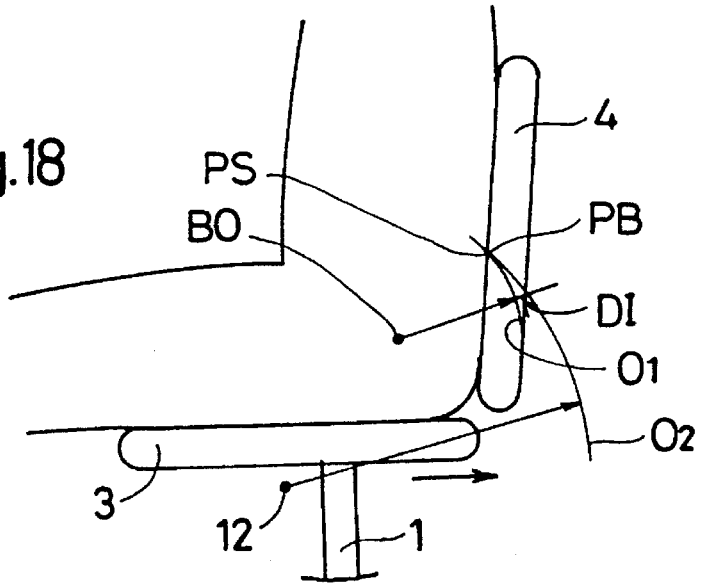
FIG. 18 is an illustrative view showing why a pull to the clothing of the seat occupant takes place.

Such sliding movement of the seat 3 attendant with the rearward pivoting of the seat back 4 is preferred for preventing the user's shirt (or other clothing) from being unexpectedly pulled, which phenomenon is often encountered in a conventional rocking chair wherein the seat is horizontally fixed or moves forward upon tilting of the seat back. Reference is now made to FIGS. 18 to explain this.

In FIG. 18, it is now assumed that a certain point PB of the seat occupant' back contacts a point PS of the seat back 4 when the seat occupant is in an non-reclined posture. When the seat occupant reclines on the seat back 4, the point PB of the seat occupant's back moves along an arcuate path O1 centered about a hip point BO slightly above the seat 3, whereas the point PS of the seat back 4 moves along another arcuate path O2 centered about the second pivot shaft 12. Since the radius of the arcuate path O1 is much small than that of the other arcuate path O2, the point PB of the seat occupant's back inevitably deviates from the point PS of the seat back 4 by an amount DI which increases with the tilting angle of the seat back 4. Apparently, the shirt of the seat occupant is pulled by an amount corresponding to this devitation DI.

According to the first embodiment, the seat 3 slides rearward to compensate for the above-mentioned deviation DI when the seat back 4 tilts rearwardly downward. Thus, the shirt of the seat occupant is effectively prevented from being pulled at the time of rocking.

Figure 19:
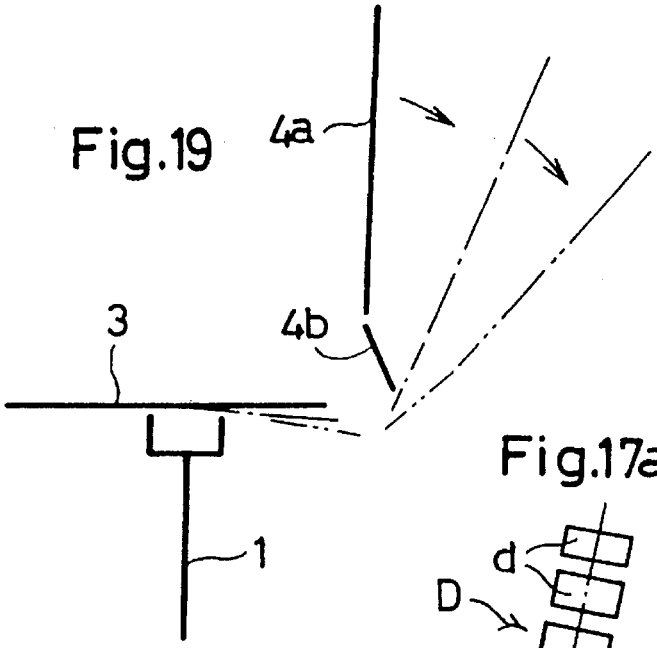
FIG. 19 is a schematic side view showing a chair according to a second embodiment of the present invention.

(2) Embodiment 2 (FIG. 19):

FIG. 19 schematically shows a chair according to a second embodiment of the present invention. The chair of this embodiment is substantially the same as that of the first embodiment but differs therefrom only in that the waist supporting portion 4b of the seat back is separate from the back supportion portion 4a.

(3) Embodiment 3 (FIGS. 20–33):

FIGS. 20–33 show a chair according to a third embodiment of the present invention. The chair of this embodiment is similar to that of the first embodiment but slightly differs therefrom, as described below.

According to the third embodiment, a control plate 35 rotatably supporting, at its upper end, a pressing roller 37 is fixed to the rear end of the stationary frame 7. Thus, the pivotal frame 32 (see FIG. 1) provided for the first embodiment is omitted.

As shown in FIGS. 20, 21, 23, 24 and 31, the seat back 4 has an upper back supporting portion 4a and a lower waist supporting portion 4b. Further, the seat back 4 comprises an inner shell plate 14, and an outer shell plate 15 having side walls 15a and joined to the inner shell plate 14 to define a hollow shell which is downwardly open. Due to the rigidity provided by the side walls 15a of the outer shell plate 15, the back supporting portion 4a of the seat back 4 is prevented from elastic deformation. Conversely, the waist supporting portion 4b of the seat back 4 is rendered elastically flexible by forming a plurality of rearwardly open slits 17 at a portion of the outer shell plate 15 corresponding to the waist supporting portion 4b.

To facilitate the elastic deformation of the waist supporting portion 4b of the seat back 4, the respective slits 17 of the outer shell plate 15 slightly flare toward the inner shell plate 14. However, when the waist supporting portion 4b is deformed substantially into a straight form, the respective slits 17 are closed rearwardly, so that further deformation of the waist supporting portion 4b is prevented.

Figure 22:
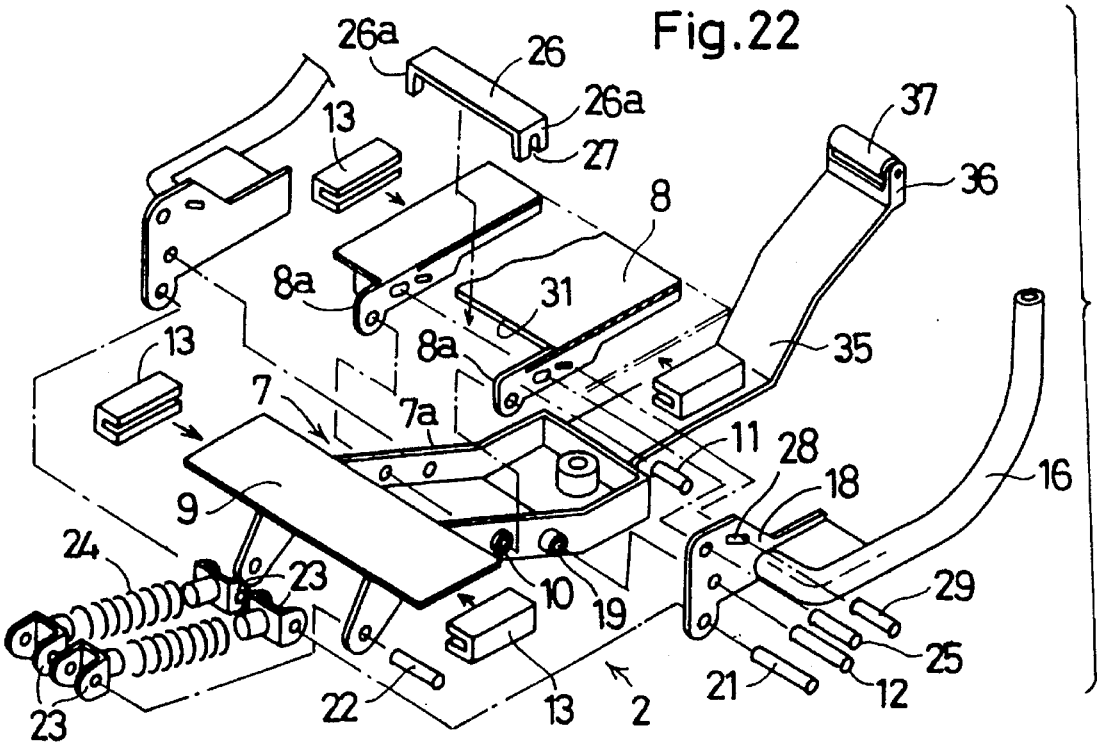
FIG. 22 is an exploded perspective view showing various components incorporated in the chair of FIG. 20.
Figure 23:
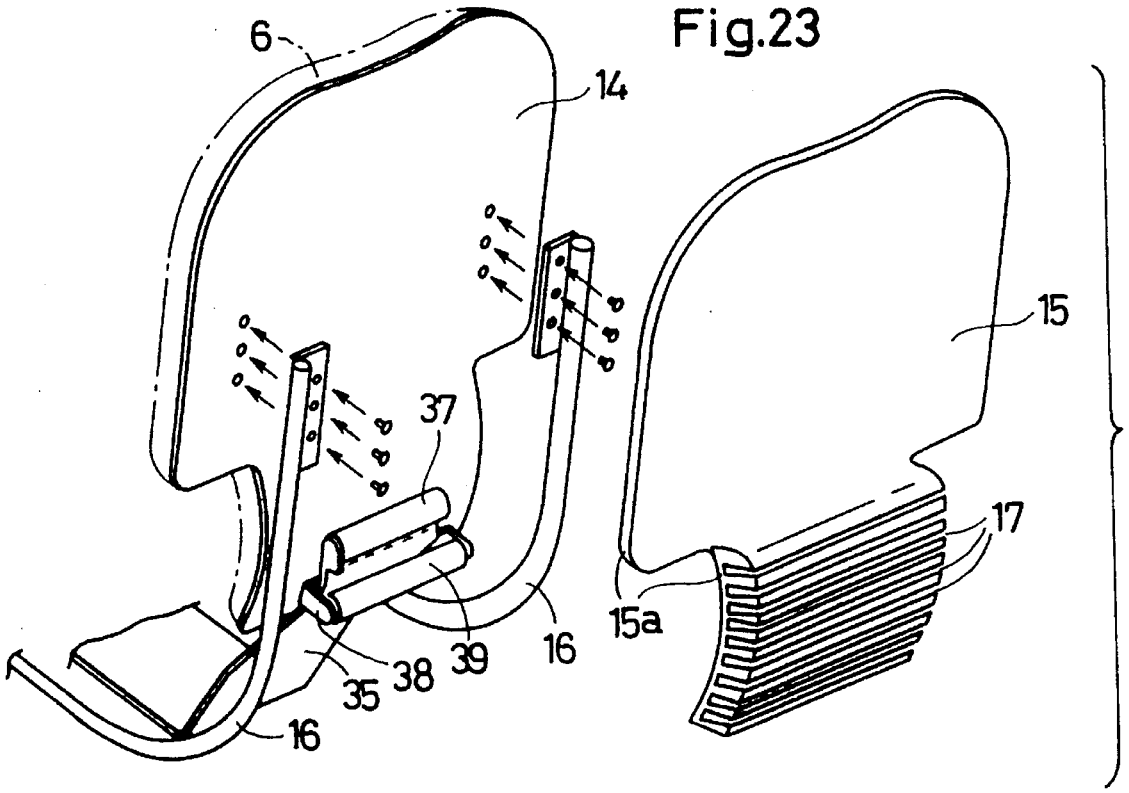
FIG. 23 is a perspective view showing the seat back of the chair according to the third embodiment.
Figure 27:
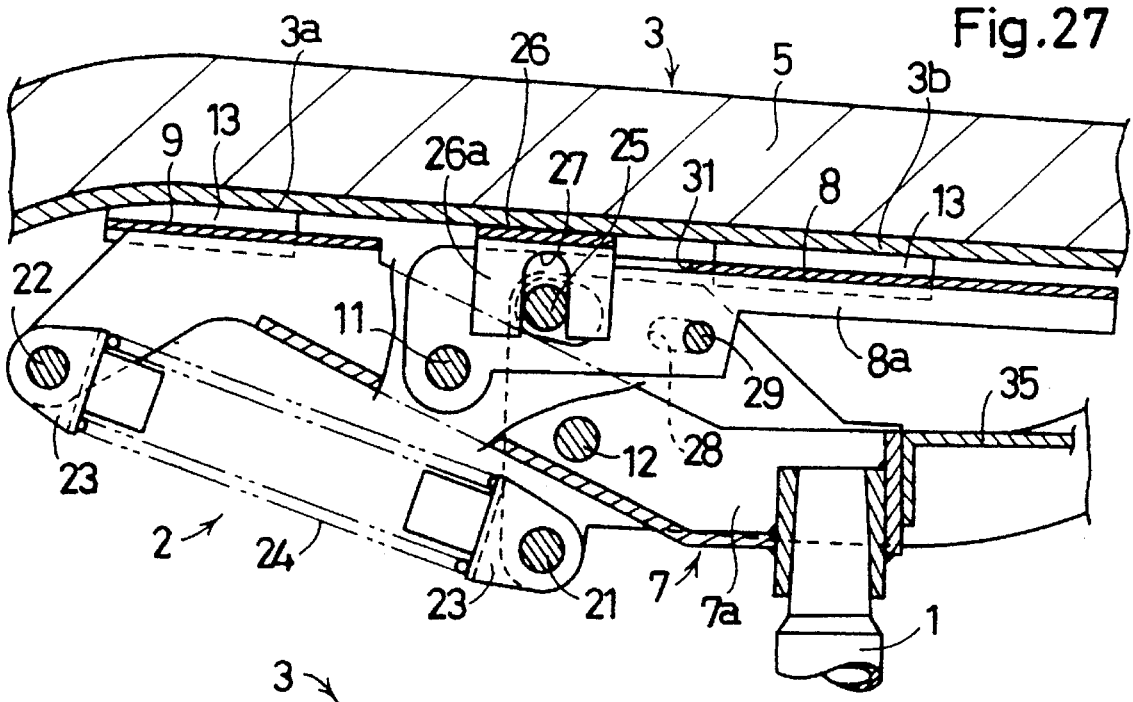
FIG. 27 is a sectional plan view taken along lines 27—27 in FIG. 25.
Figure 28:
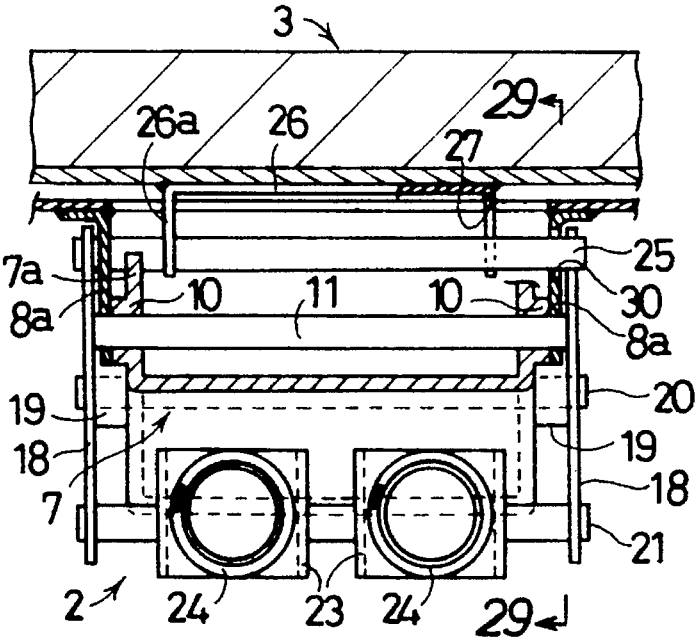
FIG. 28 is a sectional plan view taken along lines 28—28 in FIG. 25.
Figure 29:
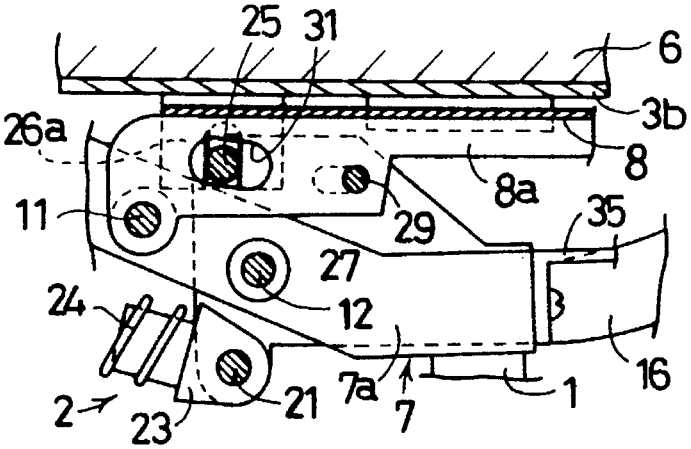
FIG. 29 is a sectional plan view taken along lines 29—29 in FIG. 25.
Figure 30:
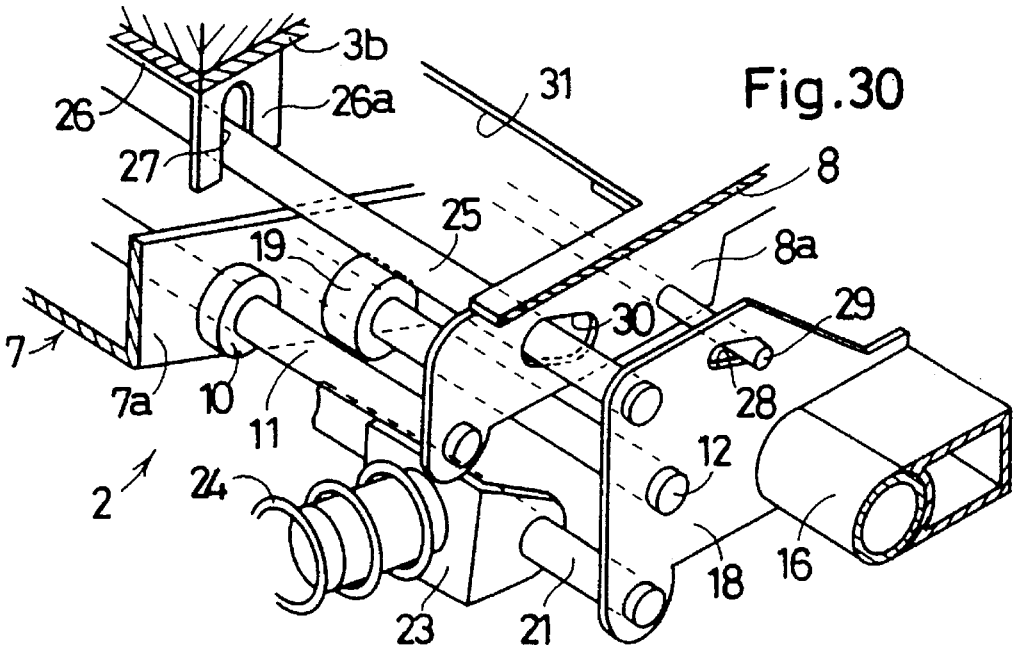
FIG. 30 is a fragmentary perspective view showing a movable carrier plate incorporated in the chair of the third embodiment together with its related components.

As shown in FIG. 22, each of the second bearings 19 for the second pivot shaft 12 is made to project by a greater extent than each of the first bearings 10 for the first pivot shaft 11. Due to such an arrangement, each of the seat back supporting arms 16 can pivot rearwardly downward without interfering with the movable carrier plate 8. According to the first embodiment, by contrast, each of te first bearings 10 is higher than each of the second bearings 19 because of the provision of the pivotal frame 32.

Similarly to the first embodiment, the rear portion 3b of the seat 3 is inclined rearwardly downward under the rearwardly shifted weight of the seat occupant as guided by the combination of the oblique guide slots 28 and the guide shaft 29 while slidably moving rearward as guided by the sliders 13. On the other hand, the front portion 3a of the seat 3 slidably moves only horizontally due to the guiding function provided by the stationary carrier plate 9.

The Japanese Industrial Standard (JIS) defines a back supporting point of a chair as the point at which the user's back contacts a seat back, as indicated by reference sign P in FIG. 20. On the other hand, the JIS also defines a seat standard point as the point of the seat at which the weight of the user is centrally applied, as indicated by reference sign H in FIG. 20. According to the third embodiment, the distance L1 (see FIG. 20) between the back supporting point P and seat standard point H before the seat back 4 is tilted rearward is set smaller than the distance 42 (see FIG. 33) between the same two points P, H after the seat back 4 is fully tilted rearward. Specifically, the difference between L1 and L2 may be about 4 mm for achieving comfortable rocking of the chair.

Figure 31:
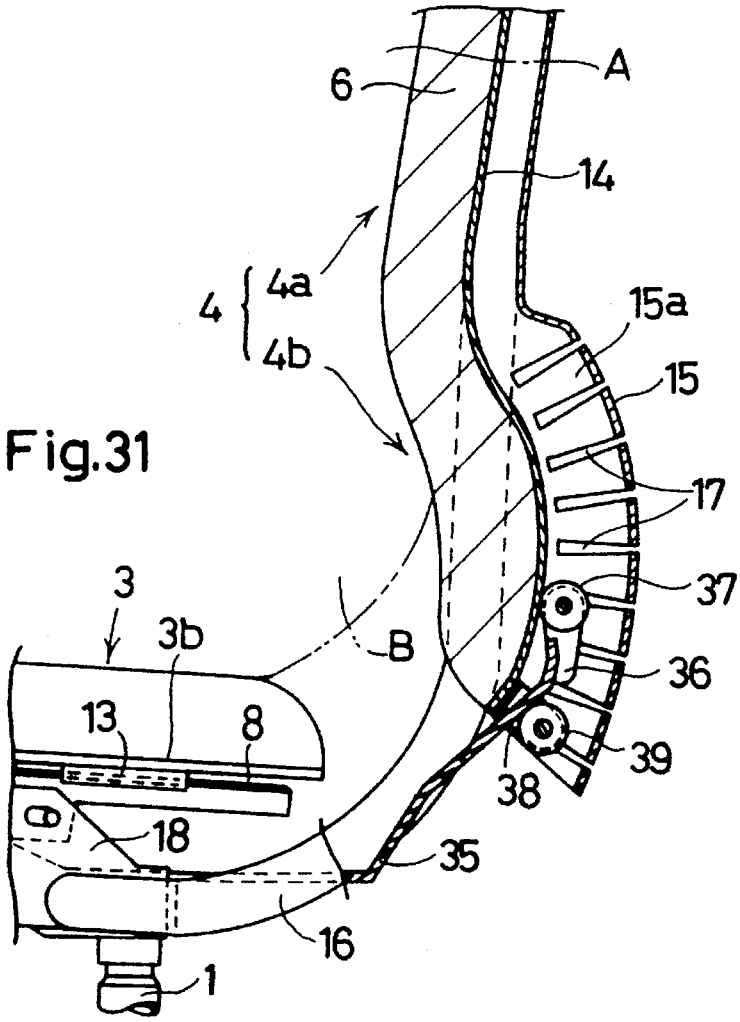
FIG. 31 is a fragmentary side view showing the details of the seat back incorporated in the chair according to the third embodiment.

When the seat occupant reclines, the seat back 4 tilts rearwardly downward together with the seat back supporting arms 16. However, since the control plate 35 is fixed to the stationary frame 7, the posture of the control plate 35 remains unchanged. Thus, the pressing roller 37 presses the waist supporting portion 4b of the tilting seat back 4 to progressively deform it into a straightened form, as shown in FIGS. 31–33.

On the other hand, when the waist supporting portion 4b of the tilting seat back 4 is fully straightened, the respective slits 17 are forwardly closed. Thus, the waist supporting portion 4b is prevented from being excessively deformed (namely, forwardly bulging). As a result, the seat back 4 provides a comfortable rocking for the seat occupant throughout the entire rocking range.

For comparison, FIG. 34 shows a conventional chair having a tiltable seat back 4' which comprises an upper back supporting portion 4a' and a lower waist supporting portion 4b'. The seat back 4' includes a shell which consists of an inner shell plate 14' and an outer shell plate 15', and a fixed support 35' has an upper end extending into the shell and pivotally connected to the inner shell plate 14' at the waist supporting portion 4b'. Thus, for enabling tilting of the seat back 4, the outer shell plate 15' must be greatly bulged rearward at the waist supporting portion 4b', consequently deteriorating the overall appearance.

By contrast, according to the third embodiment (and the first and second embodiments as well), the waist supporting portion 4b of the seat back 4 is made to deform forwardly as the seat back 4 tilts rearwardly downward. Thus, the outer shell plate 15 need not be greatly bulged at the waist supporting portion 4b.

Figure 35:
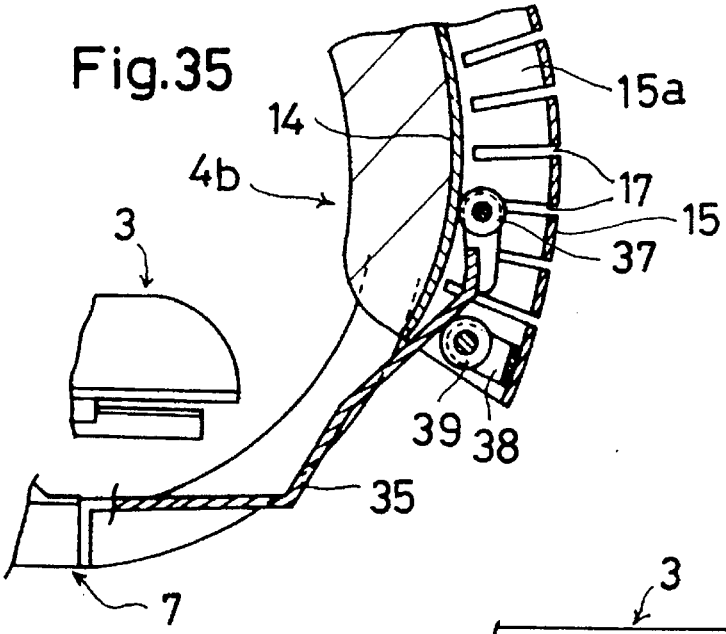
FIG. 35 fragmentary side view, partly in section, showing a chair according to a fourth embodiment of the present invention.

(2) Embodiment 4 (FIG. 35):

FIG. 35 shows only a principal portion of a chair according to a fourth embodiment of the present invention. The chair of this embodiment is substantially the same as that of the third embodiment (FIGS. 20–33) but differs therefrom only in two points. First, a regulating roller 38 rotatably supported by a pair of mounting brackets 38 is carried by the outer shell plate 15. Secondly, each of respective slits 17 for imparting elastic flexibility to the waist supporting portion of the seat back is made to have a substantially constant clearance in the 4b. *natural state of the waist supporting portion*

Figure 36:
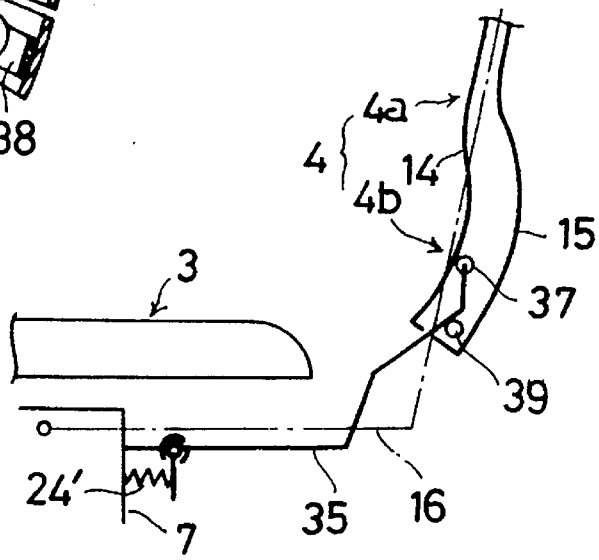
FIG. 36 is a schematic side view section showing a chair according to a fifth embodiment of the present invention.

(5) Embodiment 5 (FIG. 36):

FIG. 36 schematically shows a chair according to a fifth embodiment of the present invention. The chair of this embodiment is substantially the same as that of the third embodiment (FIGS. 20–33) but differs therefrom only in that a control plate 35 is made to pivot rearwardly downward against a second spring 24' which is stronger in urging force than the tilting control springs 24 (see FIG. 22).

Figure 37:
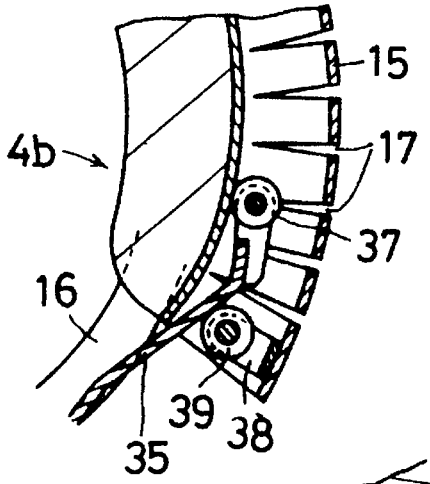
FIG. 37 is a fragmentary sectional side view showing a chair according to a sixth embodiment of the present invention.

(6) Embodiment 6 (FIG. 37):

FIG. 37 shows only a principal portion of a chair according to a sixth embodiment of the present invention. The chair of this embodiment is substantially the same as that of the fourth embodiment (FIG. 35) but differs therefrom only in that each of respective slits 17 for imparting elastic flexibility to the waist supporting portion of the seat back is made to flare toward the outer shell plate 15 in the natural state of the waist supporting portion 4b.

Figure 38:
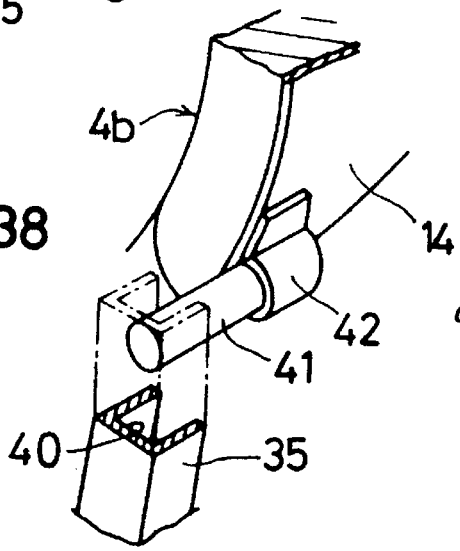
FIG. 38 is a fragmentary perspective view showing a chair according to a seventh embodiment of the present invention.

(7) Embodiment 7 (FIG. 38):

FIG. 38 shows only a principal portion of a chair according to a seventh embodiment of the present invention. The chair of this embodiment is substantially the same as that of the third embodiment (FIGS. 20–33) but differs therefrom only in two points. First, the control plate of the third embodiment is replaced by a pair of control guide rails 35 (only one shown) each having a guide groove 40. Secondly, a pressing rod 41 slidably guided in the guide groove 41 of each control rail 35 is attached to the inner shell plate 14 by brackets 42.

Figure 39:
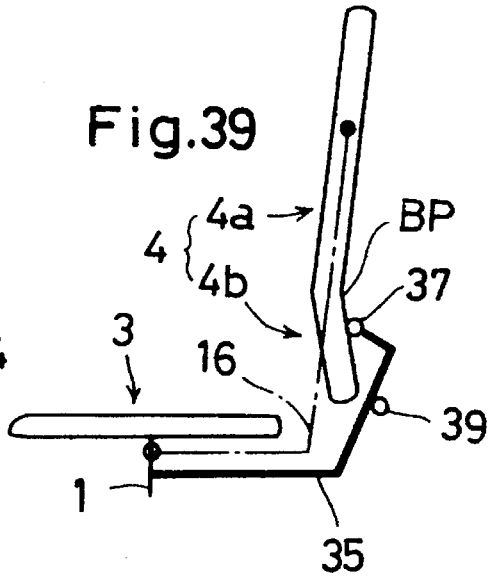
FIG. 39 is a schematic side view section showing a chair according to an eighth embodiment of the present invention.
Figure 40:
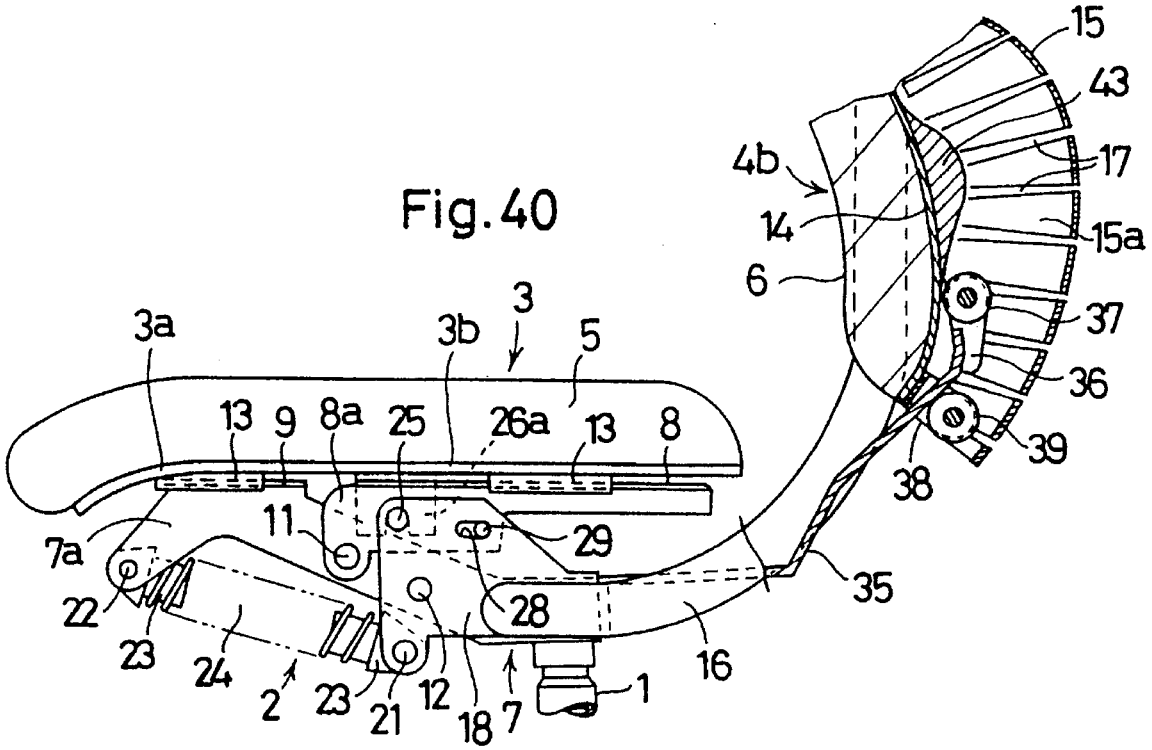
FIG. 40 is a fragmentary side view showing a principal portion of a chair according to a ninth embodiment of the present invention.
Figure 41:
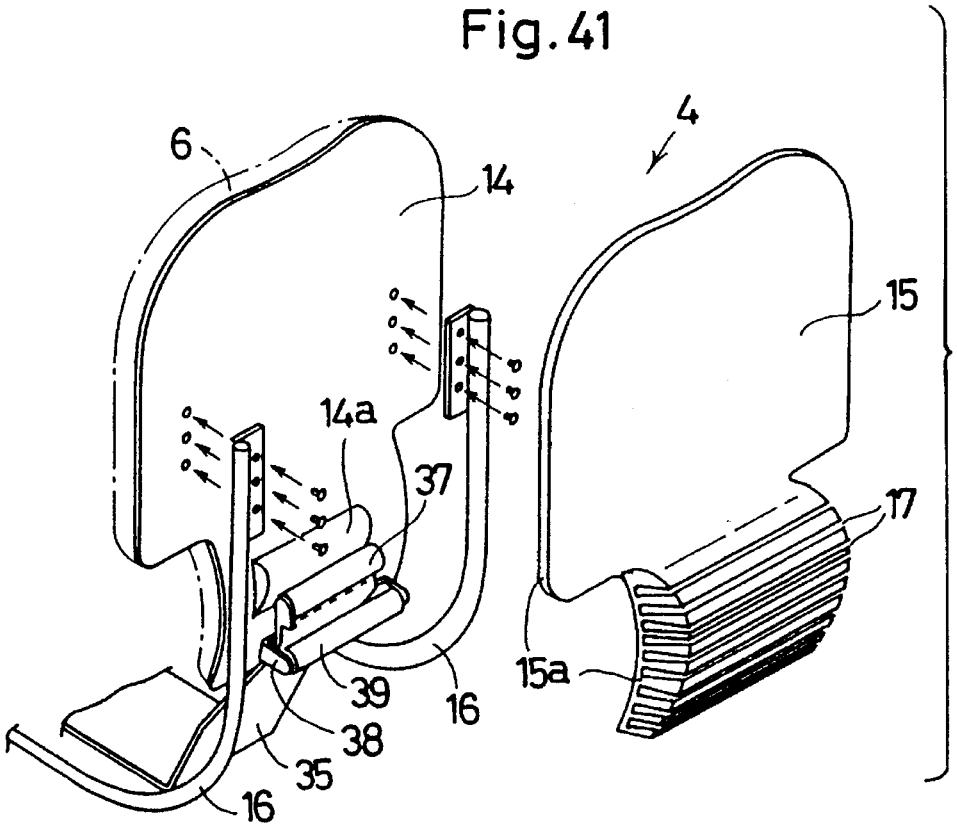
FIG. 41 is a perspective view showing the seat back of the chair according to the third embodiment.

(8) Embodiment 8 (FIG. 39):

FIG. 39 schematically shows a chair according to a eighth embodiment of the present invention. The chair of this embodiment is substantially the same as that of the third embodiment (FIGS. 20–33) but differs therefrom in that a seat back 4 comprises a substantially straight back supporting portion 4a and a substantially straight waist supporting portion 4b which is bendable at a bending point BP relative to the back supporting portion 4a. In the eighth embodiment, flexibility imparting slits (like elements 17 in FIG. 31) may be provided at and near the bending point BP, so that the waist supporting portion 4b is progressively bent relative to the back supporting portion 4a as the seat back 4 tilts rearwardly downward.

(9) Embodiment 9 (FIGS. 40–44)

FIGS. 40 through 44 show a chair according to a ninth embodiment of the present invention. The chair of this embodiment is substantially the same as that of the third embodiment (FIGS. 20–33) but differs therefrom in that the inner shell plate 14 of the seat back 4 is internally formed, at the waist supporting portion 4b, with a mountain-like cam bulge 43 operatively associated with the pressing roller 37. The cam bulge 43 may be made of hard rubber for example and attached to the inner shell plate 14 by adhesive.

Figure 42:
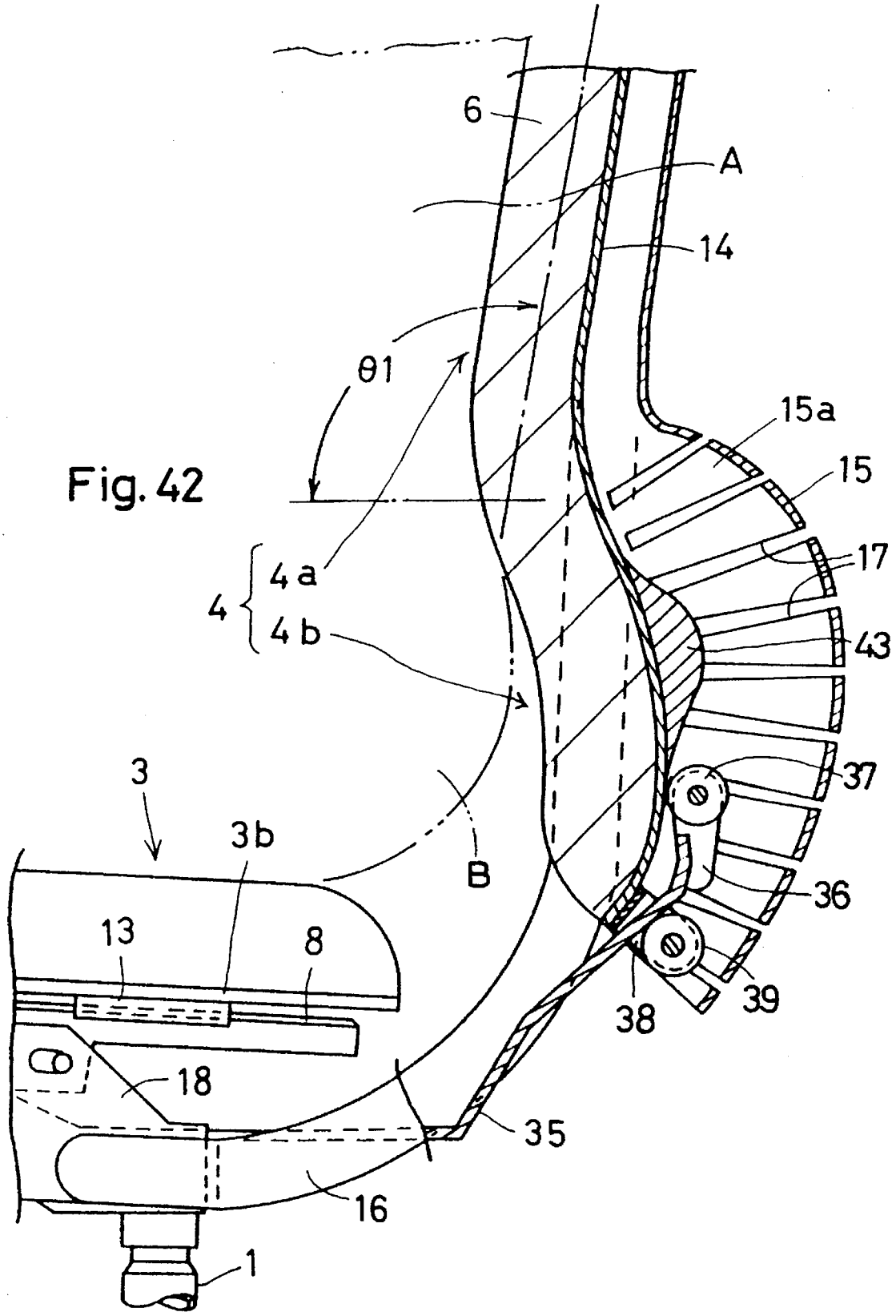
FIG. 42 is a side view similar to FIG. 40 but showing the same chair in an enlarged scale partly in section.
Figure 43:
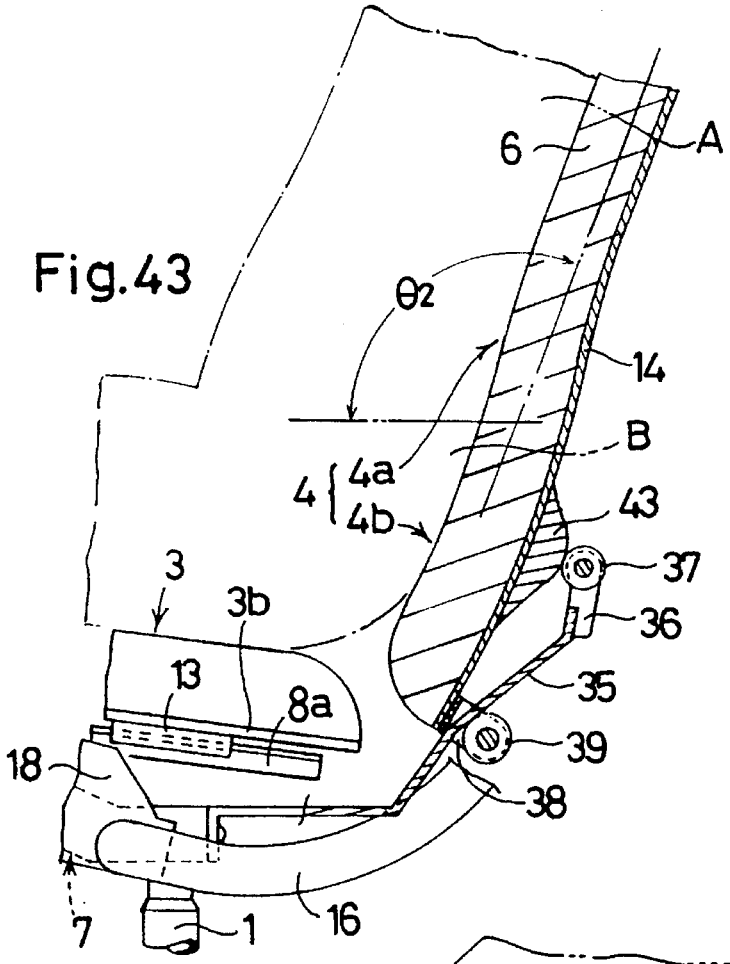
FIG. 43 is a fragmentary side view similar to FIG. 42 but showing the same chair with the seat back tilted halfway.
Figure 44:
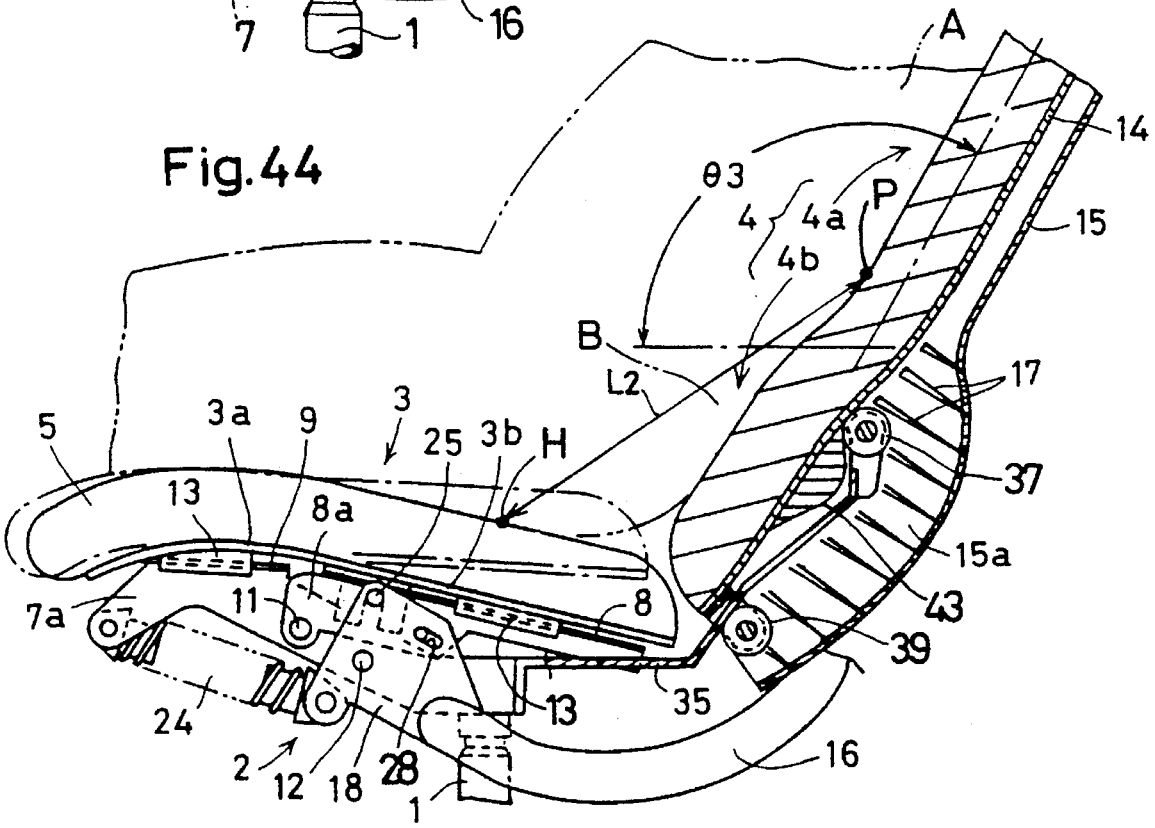
FIG. 44 is a fragmentary side view similar to FIG. 42 but showing the same chair with the seat back tilted fully.
Figure 50:
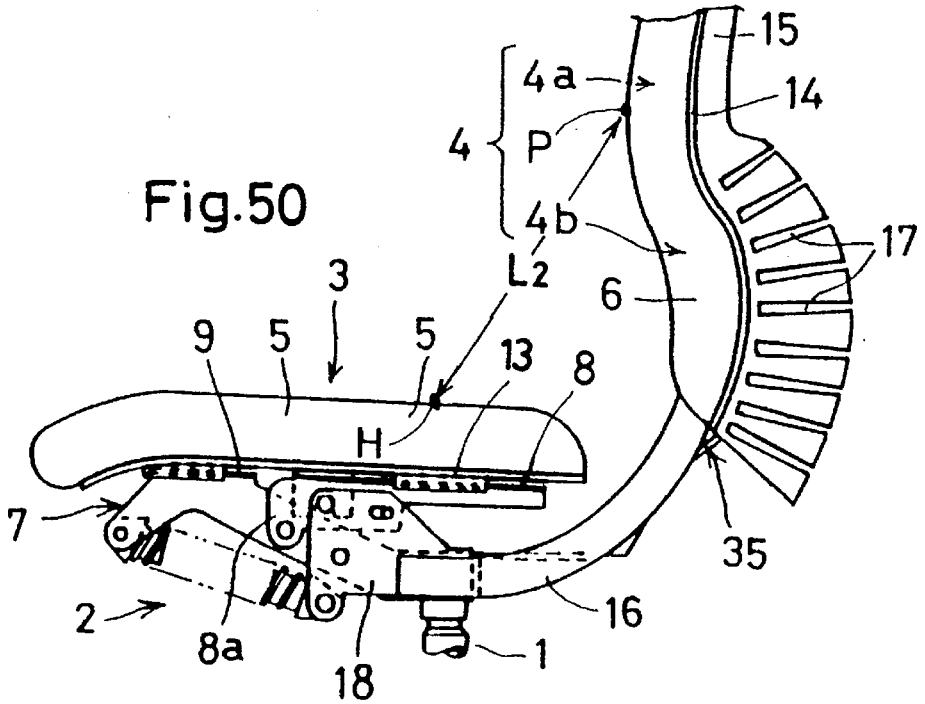
FIG. 50 is a fragmentary side view showing a principal portion of a chair according to a thirteenth embodiment of the present invention.
Figure 51:
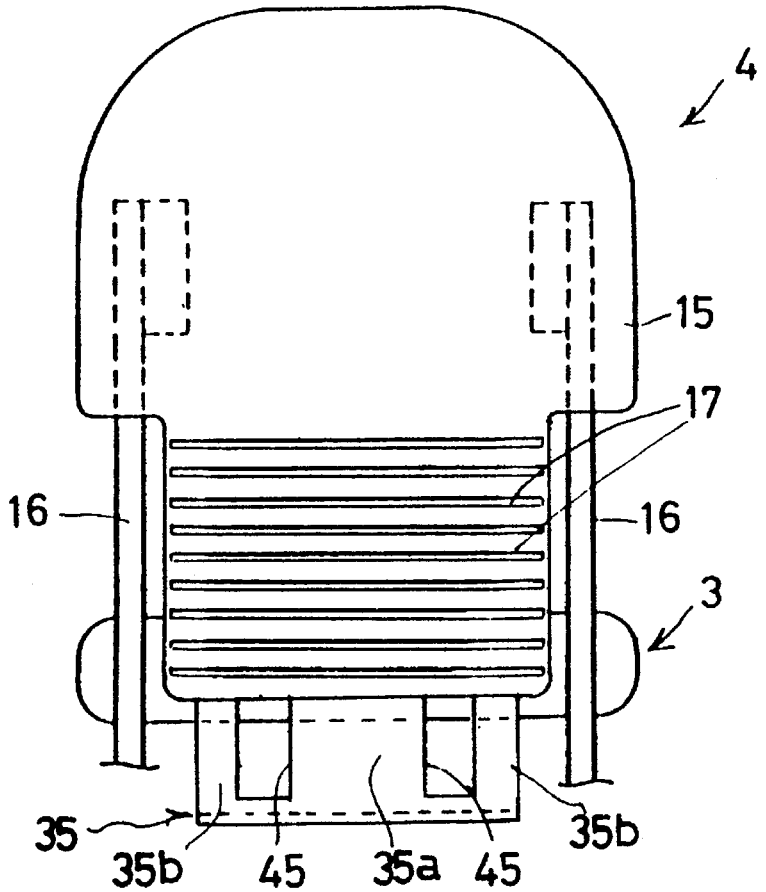
FIG. 51 is a rear view of the chair shown in FIG. 50.

The configuration of the cam bulge 43 in relation to the pressing roller 37 is selected in the following manner. In the absence of any load against the seat back 4, the pressing roller 37 is positioned at the lower margin of the cam bulge 43, as shown in FIG. 42. When the seat back 4 is rearwardly tilted halfway to a predetermined inclination angle Θ2 of about 110° for example, the pressing roller 37 is located at the apex of the cam bulge 43, as shown in FIG. 43. When the seat back 4 is tilted fully to a rearward limit angle Θ3 of about 120° for example, the pressing roller 37 is located at the upper margin of the cam bulge 43, as shown in FIG. 44.

According to the ninth embodiment, when the seat back tilts up to the predetermined inclination angle Θ2, the pressing roller 37 first climbs up the cam bulge 43, so that the pressing roller 37 forwardly presses the waist supporting portion **4*b* of the seat back 4 at a very high rate. However, beyond this inclination angle, the pressing roller 37 climbs down the cam bulge 43, so that the forwardly deforming rate of the waist supporting portion 4*b* reduces greatly to prevent the waist supporting portion 4*b*** from being excessively pushed forward. In this way, it is possible to provide comfortable rocking for the seat occupant throughout the entire tilting range.

(10) Embodiment 10 (FIG. 45):

FIG. 45 shows only a principal portion of a chair according to a tenth embodiment of the present invention. The chair of this embodiment is substantially the same as that of the ninth embodiment (FIGS. 40–44) but differs therefrom in that, like the fourth embodiment (FIG. 35), a regulating roller 38 rotatably supported by a pair of mounting brackets 38 is carried by the outer shell plate 15.

The cam bulge 43 may be provided by a convexly curved plate which is made of a metal or hard resin and attached to the inner shell plate 14 by screwing or riveting, as shown in FIG. **46*a*. Alternatively, the cam bulge 43 may be integrally formed with the inner shell plate 14 to be hollow (see FIG. 46*b*) or solid (see FIG. 46*c*). Of course, the cam bulge 43** may be otherwise formed and/or configured.

(11) Embodiment 11 (FIGS. 47 and 48):

FIGS. 47 and 48 show only a principal portion of a chair according to a eleventh embodiment of the present invention. The chair of this embodiment is substantially the same as that of the seventh embodiment (FIG. 38) but differs therefrom in that each control guide rail 35 has an upper end portion extending along a curved path which is upwardly forwardly convex. The thus curved guide rail 35 causes the pressing rod 41 to push the waist supporting portion **4*b*** of the seat back at a higher rate only up to a predetermined inclination angle of the seat back but at a lower rate beyond this inclination angle.

(12) Embodiment 12 (FIGS. **49*a*–49*c***):

FIGS. **49*a* through 49*c* show a chair according to a twelfth embodiment of the present invention. The chair of this embodiment is substantially the same as that of the ninth embodiment (FIGS. 40–44) but differs therefrom in that a seat back 4 comprises a substantially straight back supporting portion 4*a* and a substantially straight waist supporting portion 4*b* which is bendable at a bending point BP relative to the back supporting portion 4*a*. In the twelfth embodiment, flexibility imparting slits (like element 17 in FIG. 20) may be provided at and near the bending point BP, so that the waist supporting portion 4*b* is progressively bent relative to the back supporting portion 4*a* as the seat back 4** tilts rearwardly downward.

(13) Embodiment 13 (FIGS. 50–64):

FIGS. 40 through 44 show a chair according to a thirteenth embodiment of the present invention. The chair of this embodiment is similar to that of the ninth embodiment (FIGS. 40–44) but differs therefrom in the following points.

Figure 53:
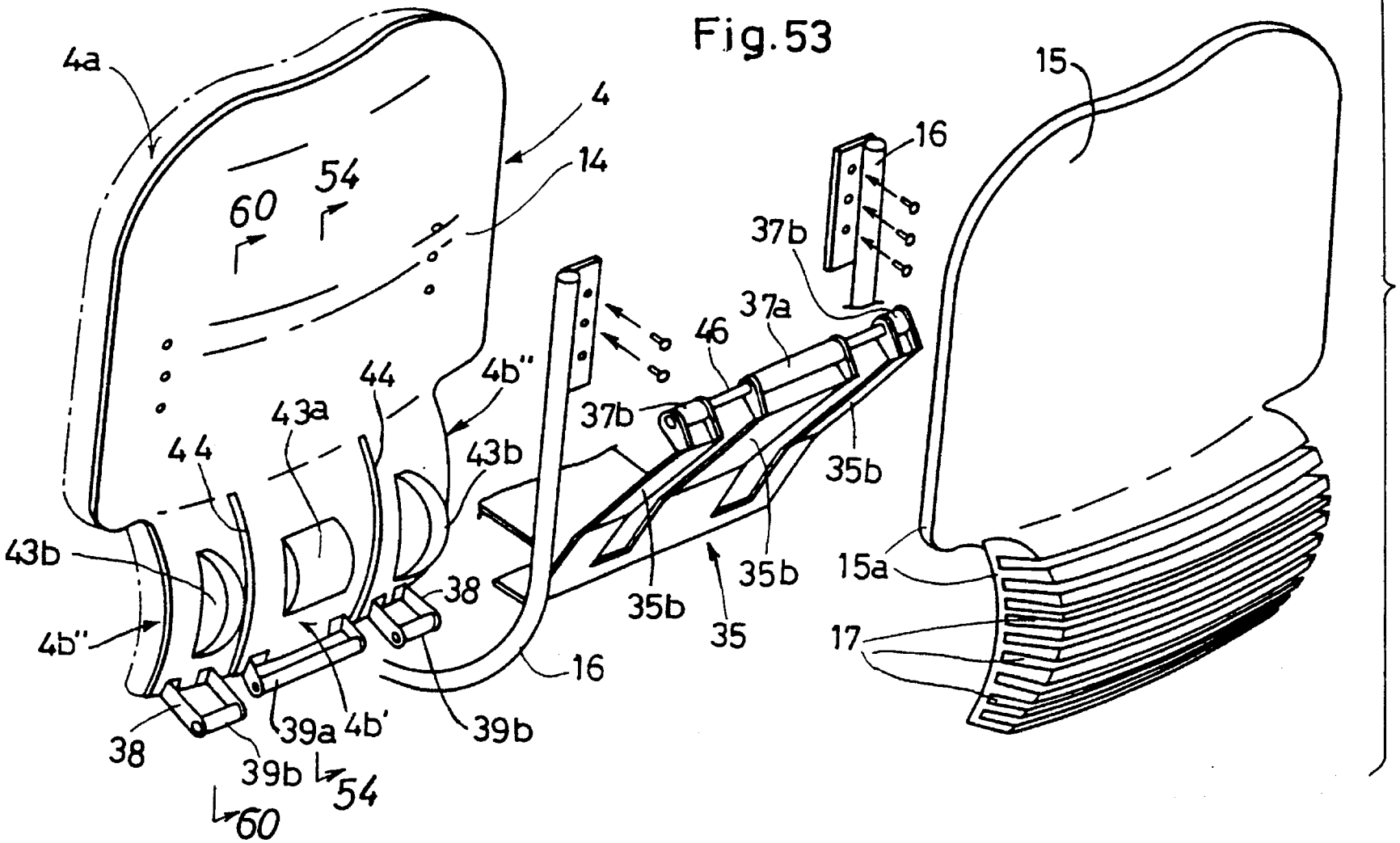
FIG. 53 is an exploded perspective view showing the seat back of the chair according to the thirteenth embodiment.

According to the thirteenth embodiment, the waist supporting portion **4*b* of the seat back 4 is divided by vertical slits 44 into a central section 4*b*' and two side sections 4*b*", as shown in FIG. 53. Thus, the three different sections 4*b*', 4*b*" of the waist supporting portion 4*b*** are independently deformable or bendable independently of each other.

Figure 54:
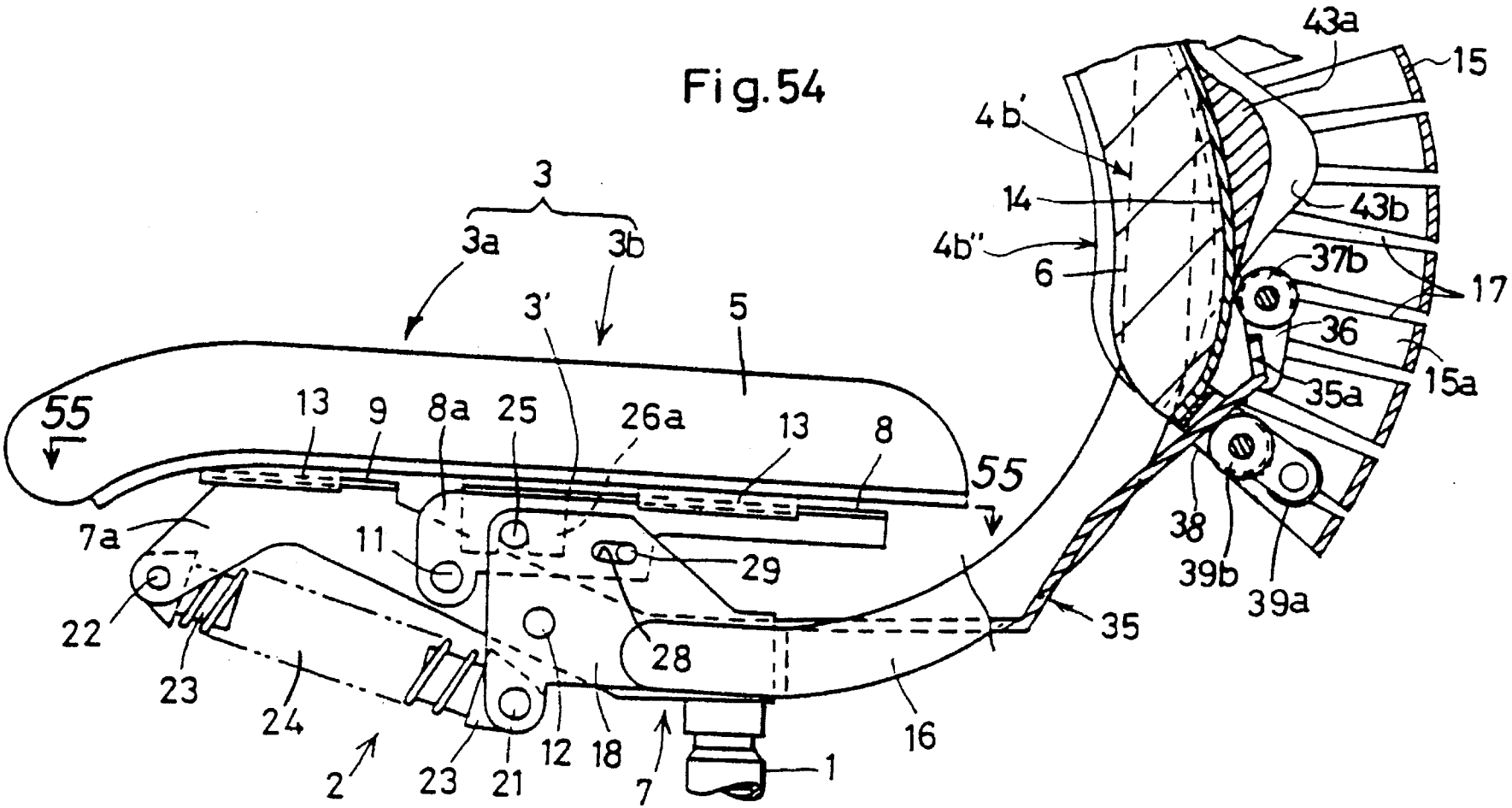
FIG. 54 is a sectional side taken along lines 54—54 in FIG.
Figure 55:
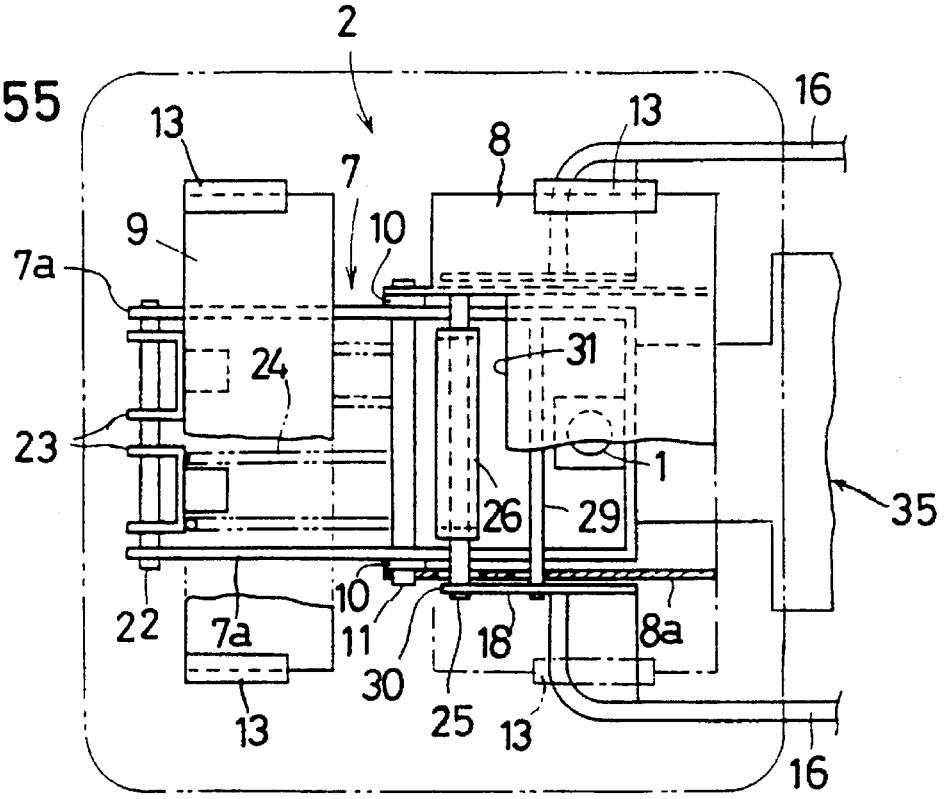
FIG. 55 is a sectional plan view taken along lines 55—55 in FIG. 24.
Figure 56:
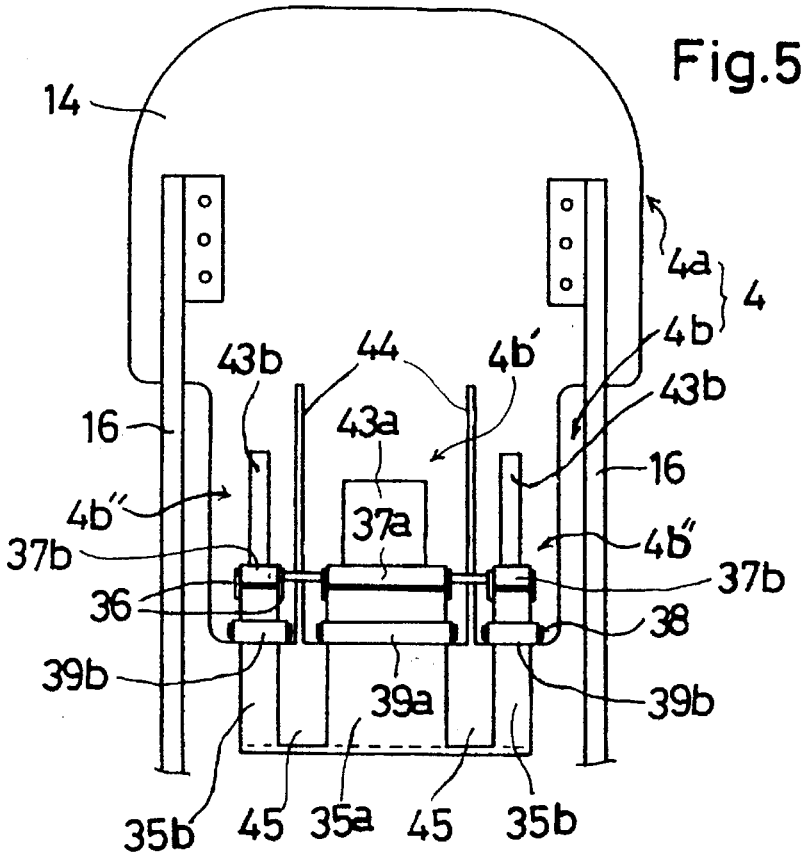
FIG. 56 is a rear view showing the seat back of the chair according to the thirteenth embodiment with its outer shell plate removed.
Figure 57:
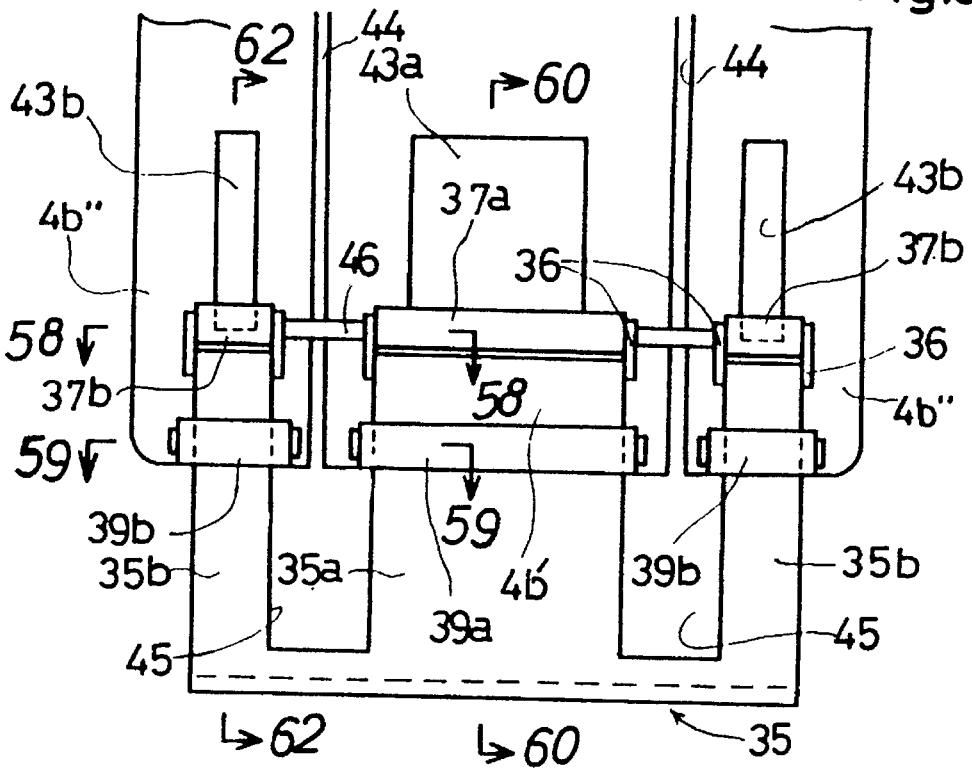
FIG. 57 is a rear view similar to FIG. 56 but showing the same seat back in an enlarged scale.
Figure 58:
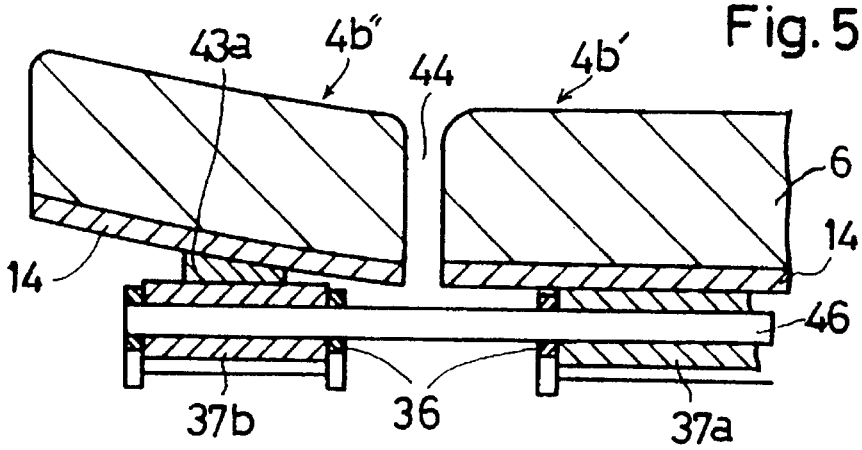
FIG. 58 is a sectional view taken along lines 58—58 in FIG. 57.
Figure 59:
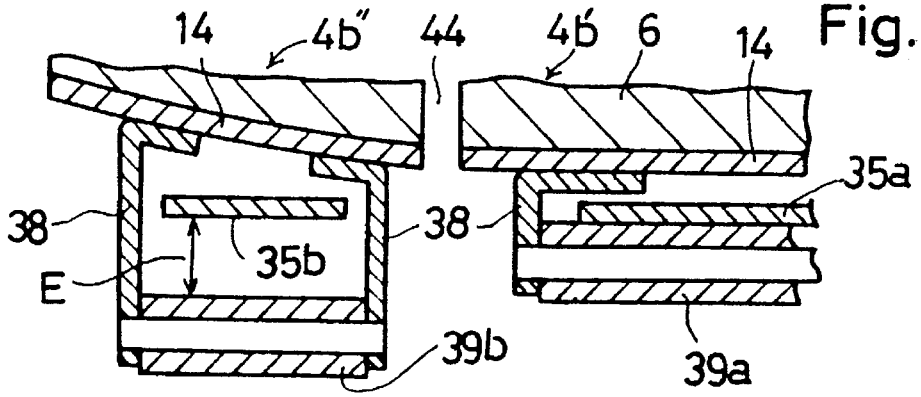
FIG. 59 is a sectional view taken along lines 59—59 in FIG. 57.
Figure 62:
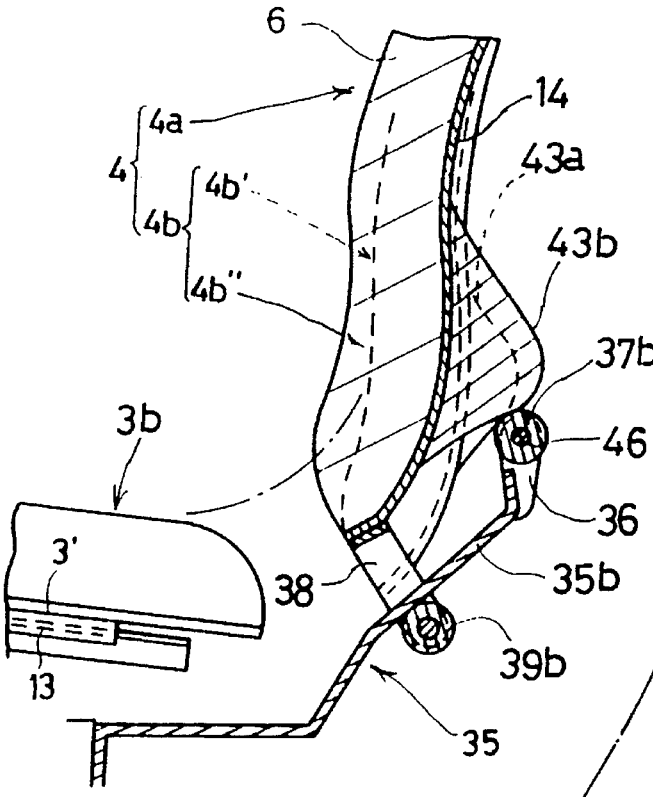
FIG. 62 is a sectional view taken along lines 62—62 in FIG. 57.

The inner shell plate 14 is internally formed, at the central section **4*b*' of the waist supporting portion 4*b*, with a central cam bulge 43*a*. Similarly, the inner shell plate 14 is internally formed, at the respective side sections 4*b*" of the waist supporting portion 4*b*, with side cam bulges 43*b*. As shown in FIG. 54, the side cam bulges 43*b* are set higher than the central cam bulge 43*a*. Each of the cam bulges 43*a*, 43*b* may be made of hard rubber for example and attached to the inner shell plate 14** by adhesive.

Figure 52:
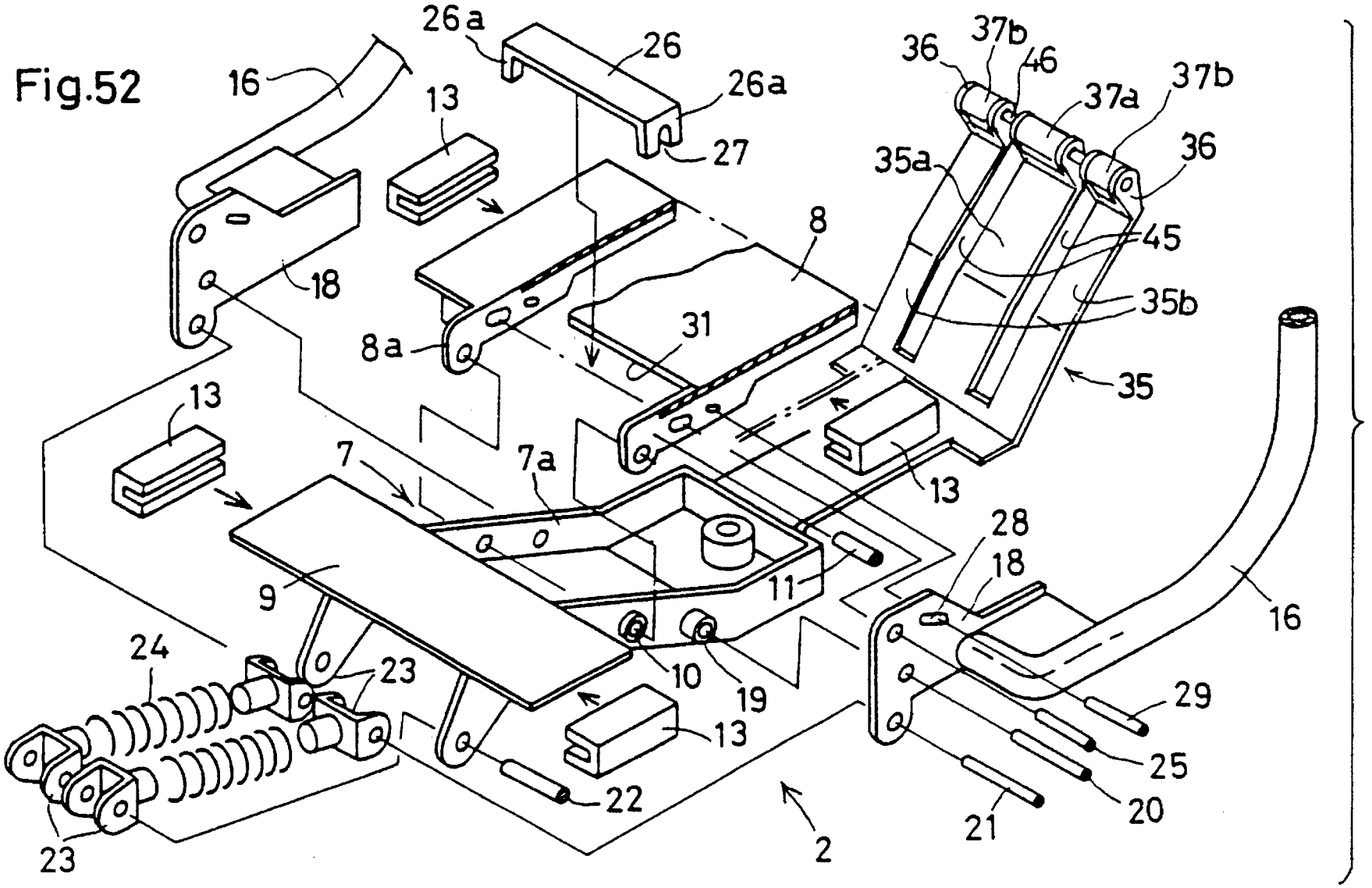
FIG. 52 is an exploded perspective view showing various components incorporated in the chair of FIG. 50.

As shown in FIGS. 53 and 52, the control plate 35 has a central riser portion **35*a* and two side riser portions 35*b* separated from the central riser portion 35*a* by vertical grooves 25. The riser portions 35*a*, 35*b* have their respective upper ends extending into the shell defined by the inner and outer shell plates 14, 15. The respective upper ends of the riser portions 35*a*, 35*b* carry a common roller shaft 46 by means of respective brackets 36 for rotatably supporting a central pressing roller 37*a* and two side pressing rollers 37*b* in corresponding relation to the central and side cam bulges 43*a*, 43*b***, respectively.

As also shown in FIGS. 53 and 52, the inner shell plate 14 is provided, at the central section **4*b*' of the waist supporting portion 4*b*, with a central regulating roller 39*a* by means of brackets 38. Similarly, the inner shell plate 14 is provided, at the respective side sections 4*b*" of the waist supporting portion 4*b*, with side regulating rollers 39*b* by means of brackets 38. As clearly seen in FIG. 59, the respective side regulating rollers 39*b* are held at a higher level than the central regulating roller 39*a*, so that there is a predetermined clearance E between the side regulating rollers 39*b* and the side riser portions 35*b* of the control plate 35 before the seat back 4** starts tilting rearwardly downward.

Figure 63:
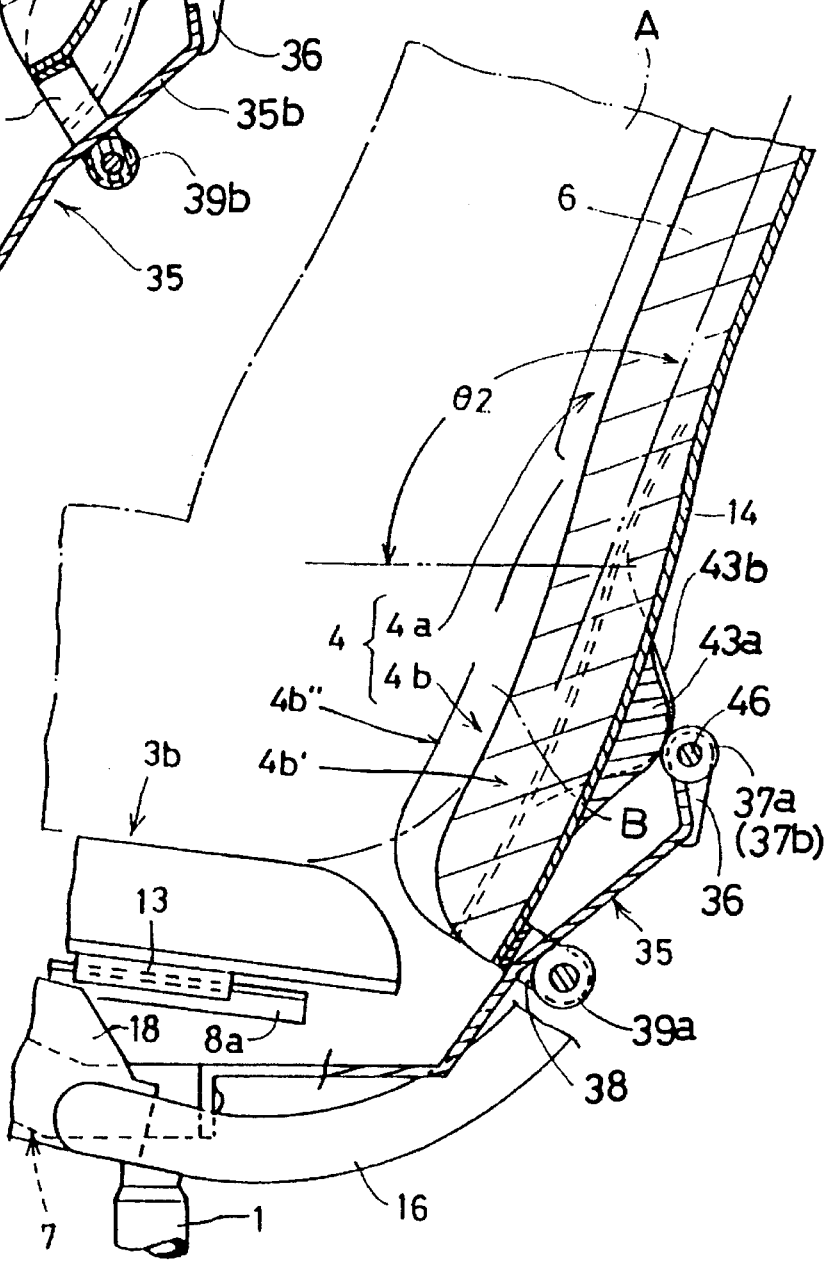
FIG. 63 is a sectional view similar to FIG. 60 but showing the same chair with its seat back tilted halfway.
Figure 64:
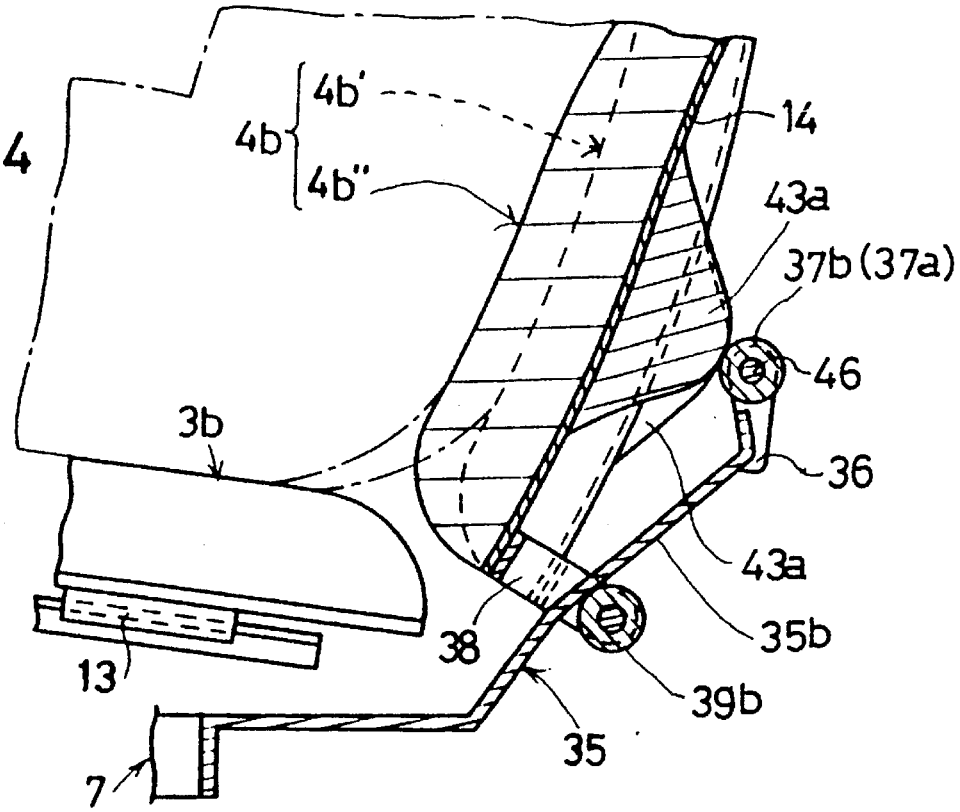
FIG. 64 is a sectional view similar to FIG. 62 but showing the same chair with its seat back tilted halfway.
Figure 65:
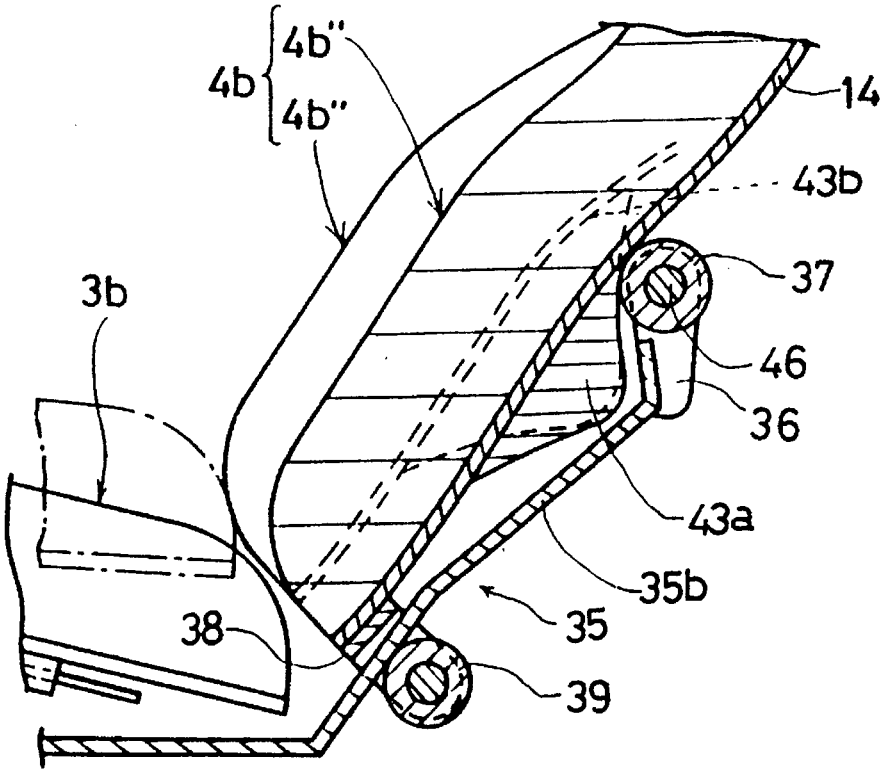
FIG. 65 is a sectional view similar to FIG. 60 but showing the same chair with its seat back tilted fully.
Figure 66:
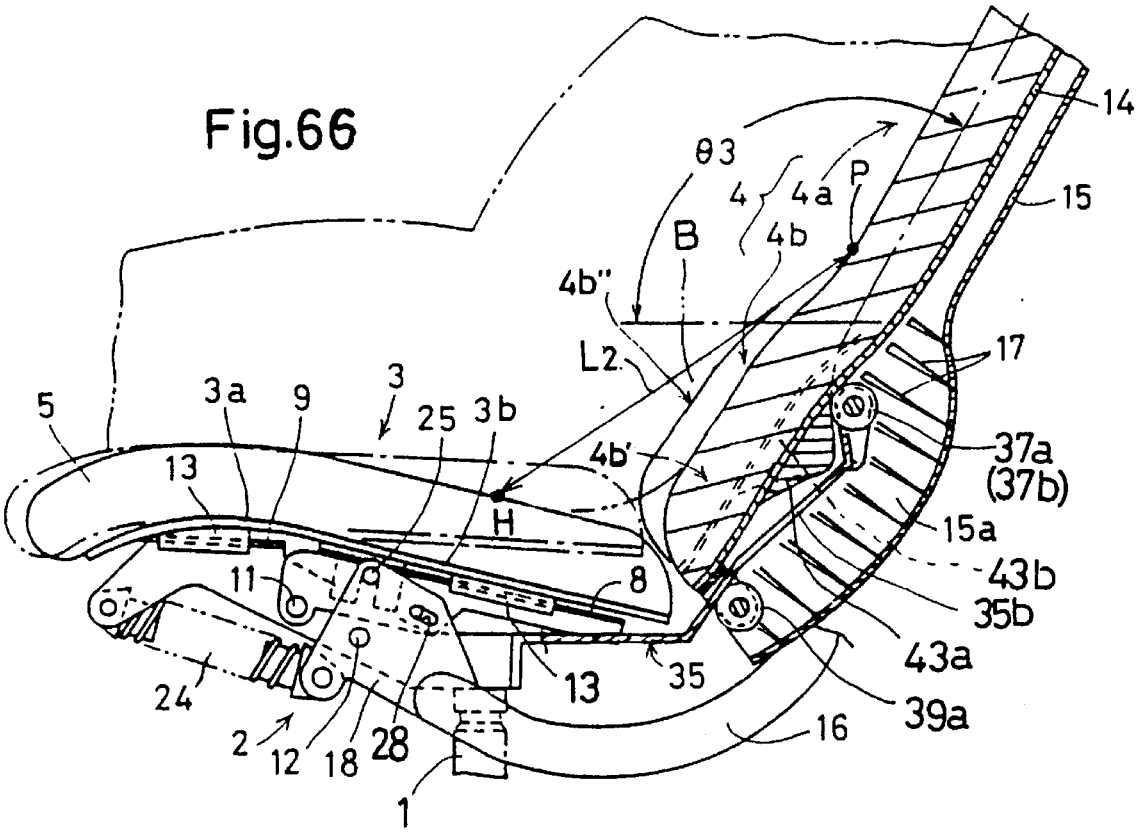
FIG. 66 is a sectional view similar to FIG. 65 but showing substantially the entirety of the same chair with its seat back tilted fully.

The configuration of each cam bulge **43*a*, 44*b* in relation to a corresponding pressing roller 37*a*, 37*b* is selected in the following manner. In the absence of any load against the seat back 4, the pressing roller 37*a*, 37*b* is positioned at the lower margin of the cam bulge 43*a*, 43*b*, as shown in FIG. 60. When the seat back 4 is rearwardly tilted halfway to a predetermined inclination angle Θ2 of about 110° for example, the pressing roller 37*a*, 37*b* is located at the apex of the cam bulge 43*a*, 43*b*, as shown in FIG. 63. When the seat back 4 is tilted fully to a rearward limit angle Θ3 of about 120° for example, the pressing roller 37*a*, 37*b* is located at the upper margin of the cam bulge 43*a*, 43*b*, as shown in FIG. 66**.

According to the thirteenth embodiment, the side cam bulges 4Bb associated with the respective side riser portions **35*b* of the control plate 35 project by a greater extent than the central cam bulge 43*a* associated with the central riser portion 35*a* of the control plate 35. Thus, the side sections 4*b*" of the waist supporting portion 4*b* of the seat back 4 are pushed or deformed forward by a greater extent than the central section 4*b*' of the waist supporting portion 4*b* when the seat back 4 is tilted rearward, as shown in FIG. 61. In this way, the waist supporting portion 4*b* as a whole embraces the waist B (or hips) of the seat occupant, thereby providing comfortable rocking for the seat occupant. It should be appreciated that the side sections 4*b*" of the waist supporting portion 4*b* of the seat back 4 can displaced forward by a larger extent than the central section 4b' because the clearance E between each side section 4b" and the corresponding side regulating roller 39b provides more movability to the side section 4b", whereas the central section 4b' is prevented from such movement by the central regulating roller 39a which is initially held in contact with the central section 4b'**.

The thirteenth embodiment may be slightly modified so that the respective pressing rollers 43a, 43b are mounted on separate roller shafts instead of the common roller shaft 46.

Figure 67:
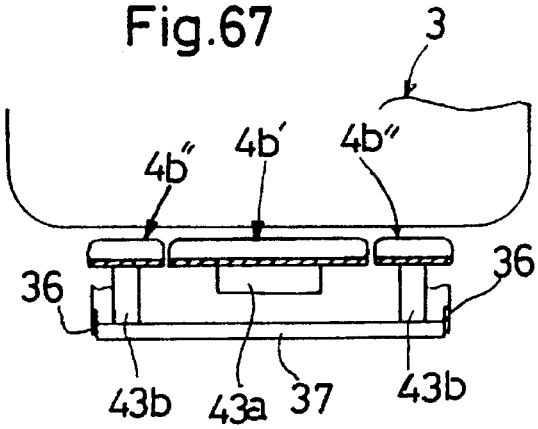
FIG. 67 is a fragmentary plan view, partly in section, showing a chair according to a fourteenth embodiment of the present invention.

(14) Embodiment 14 (FIG. 67):

FIG. 67 shows only a principal portion of a chair according to a fourteenth embodiment of the present invention. The chair of this embodiment is substantially the same as that of the thirteenth embodiment (FIGS. 50–66) but differs therefrom in that a single pressing roller 37 commonly cooperates with the central and side cam bulges 43a, 43b.

Figure 68:
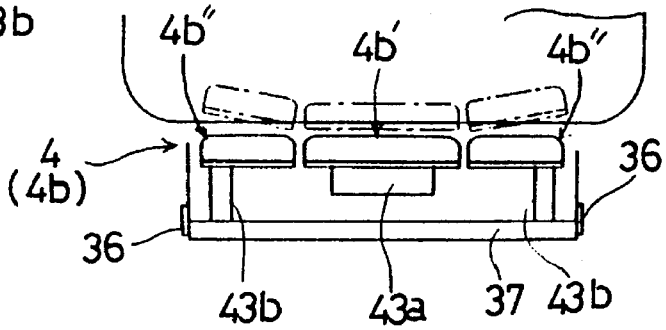
FIG. 68 is a fragmentary plan view showing a chair according to a fifteenth embodiment of the present invention.

(15) Embodiment 15 (FIG. 68):

FIG. 68 shows only a principal portion of a chair according to a fifteenth embodiment of the present invention. The chair of this embodiment is substantially the same as that of the fourteenth embodiment (FIG. 67) but differs therefrom in that the side cam bulges 43b are positioned laterally offset outward relative to the side sections 4b" of the waist supporting portion 4b of the seat back 4. Such offsetting of the side cam bulges 43b improves the embracing ability of the waist supporting portion 4b relative to the hips of the seat occupant.

Figure 69:
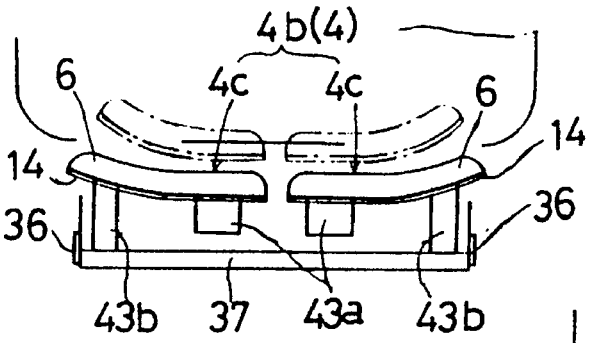
FIG. 69 is a fragmentary plan view showing a chair according to a sixteenth embodiment of the present invention.

(16) Embodiment 16 (FIG. 69):

FIG. 69 shows only a principal portion of a chair according to a sixteenth embodiment of the present invention. The chair of this embodiment is similar to that of the fourteenth embodiment (FIG. 67) but differs therefrom in two points. First, the waist supporting portion 4b of the seat back 4 comprises two sections 4c instead of three. Secondly, each of the two sections 4c of the waist supporting portion 4b is provided with a laterally inner cam bulge 43a and a laterally outer cam bulge 43b which is higher than the inner cam bulge 43a. Thus, the waist supporting portion 4b of the seat back 4 is deformed to embrace the hips of the seat occupant when the seat back 4 tilts rearwardly downward.

Figure 70:
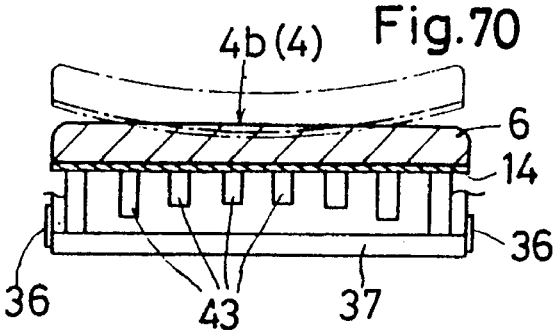
FIG. 70 is a fragmentary plan view, partly in section, showing a chair according to a seventeenth embodiment of the present invention.

(17) Embodiment 17 (FIG. 70):

FIG. 70 shows only a principal portion of a chair according to a seventeenth embodiment of the present invention. The chair of this embodiment is similar to that of the fourteenth embodiment (FIG. 67) but differs therefrom in two points. First, the waist supporting portion 4b of the seat back 4 comprises only a flexible substrate 14 and a cushion member 6 attached to the substrate 16. Secondly, the substrate 14 is provided with a number of cam bulges 43 which are spaced from each other widthwise of the seat back 4. The cam bulges 43 become progressively higher from the central portion of the waist supporting portion 4b toward the opposite sides thereof. Thus, the waist supporting portion 4b of the seat back 4 is deformed into a forwardly concave form to embrace the hips of the seat occupant when the seat back 4 tilts rearwardly downward.

Figure 71:
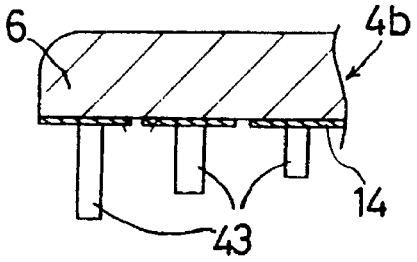
FIG. 71 is a fragmentary plan view, partly in section, showing a chair according to an eighteenth embodiment of the present invention.

(18) Embodiment 18 (FIG. 71):

FIG. 71 shows only a principal portion of a chair according to a eighteenth embodiment of the present invention. The chair of this embodiment is substantially the same as that of the seventeenth embodiment (FIG. 70) but differs therefrom in that a plurality of substrate members 14 are attached to the cushion member 6 which itself is continuous.

Figure 72:
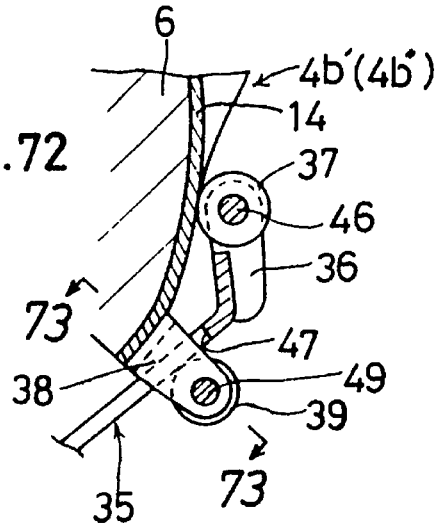
FIG. 72 is a fragmentary side view, in section, showing a chair according to a nineteenth embodiment of the present invention.
Figure 73:
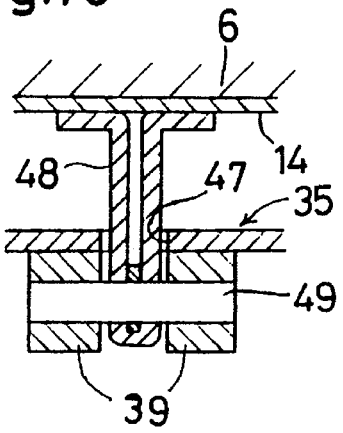
FIG. 73 is a sectional view taken along lines 73—73 in FIG. 72.
Figure 74:
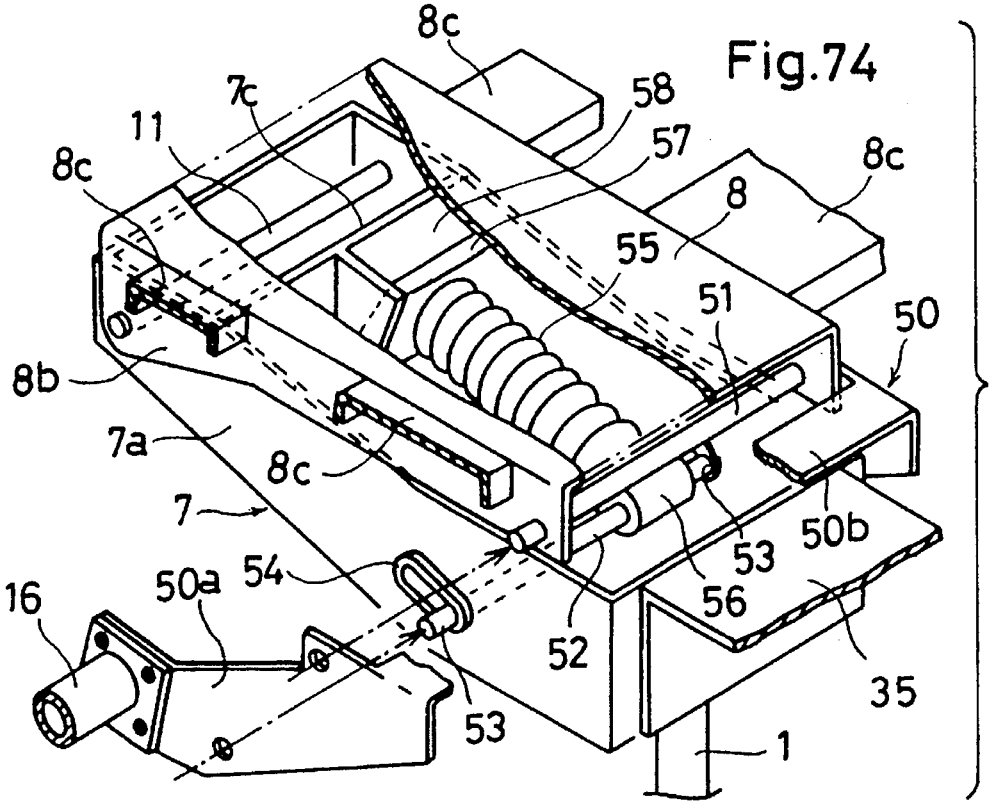
FIG. 74 is a perspective view showing a principal portion of a chair according to a twentieth embodiment of the present invention.

(19) Embodiment 19 (FIGS. 72 and 73):

FIGS. 72 and 73 show only a principal portion of a chair according to a ninteenth embodiment of the present invention. The chair of this embodiment is similar to that of the fourteenth embodiment (FIGS. 50–66) but differs therefrom in that a plurality of slits 47 are formed in the control plate 35 in corresponding relation to the respective sections 4b', 4b" of the waist supporting portion of the seat back, and a bracket 48 extends through each of the slits 47 for rotatably supporting a pair of regulating rollers 39.

(20) Embodiment 20 (FIGS. 72–77):

FIGS. 74 through 77 show a support structure of a chair according to a twentieth embodiment of the present invention.

The support structure of this embodiment comprises a stationary frame 7 having a pair of side walls 7a, and a single carrier plate 8 having a pair of side flanges 8b located laterally outwardly of the stationary frame 7 and pivotally connected to the side walls 7a of the stationary frame 7 by a first pivot shaft 11. Thus, the carrier plate 8 is capable only of pivoting rearwardly downward about the first pivot shaft 11. The side flanges 8b are provided with horizontal wings 8c for stably supporting the seat 3 (see FIG. 75).

Over a rear portion of the stationary frame 7 is fitted a pivotal frame 50 which has a pair of side walls 50a and a top plate 50b. The side walls 50a of the pivotal frame 50 have their respective forward ends fixed to respective seat back supporting arms 16 each of which is connected to the unillustrated seat back (see element 4 in FIG. 1 for example). Further, the side walls 50a of the pivotal frame 50 are located laterally outwardly from the side flanges 8a of the carrier plate 8 and pivotally connected thereto by means of a second pivot shaft 51. The top plate 50b of the pivotal frame 50 is located slightly behind the rear end of the carrier plate 8.

A guide shaft 52 extends transversely of the stationary frame 7 and penetrates through oblique guide slots 53 of the respective side walls 7a of the stationary frame 7 for connection to the respective side walls 50a of the pivotal frame 50. Each of the guide slots extends rearwardly downward and is provided with a bush 52 for protection of the guide shaft 52 which is slidable in the guide slot.

A tilting control coil spring 55 is arranged in the stationary frame 7. The coil spring 55 has a rear end seated against a rear bearing 56 which is fitted on the guide shaft 52. Further, the coil spring 55 has a front end seated against a front bearing 57 which is in turn backed up by a wedge member 58 (see FIG. 75). The stationary frame 7 has a partition wall 7c, and the wedge member 58 is interposed between the partition wall 7c and the front bearing 57.

Figure 75:
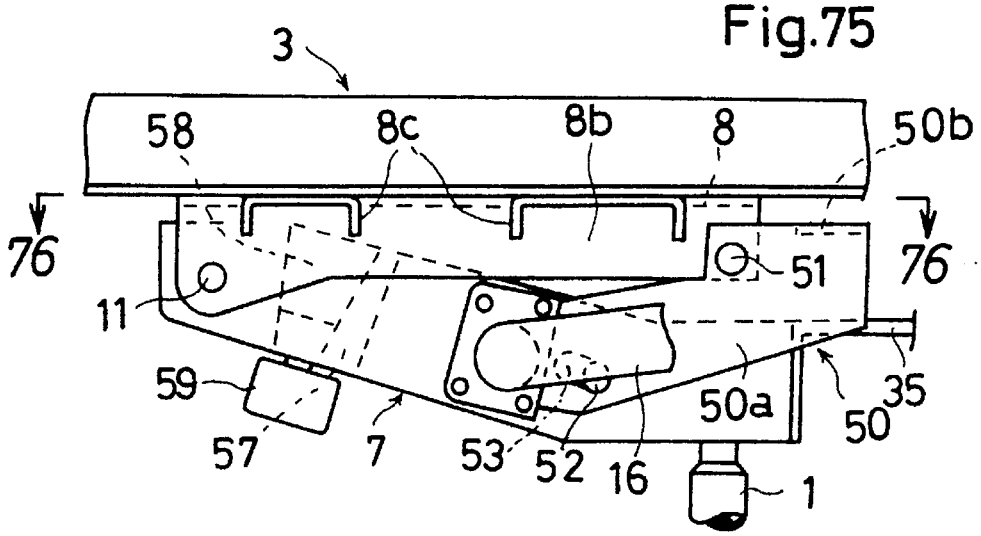
FIG. 75 is a side view showing the principal portion of the chair according to the twentieth embodiment.
Figure 76:
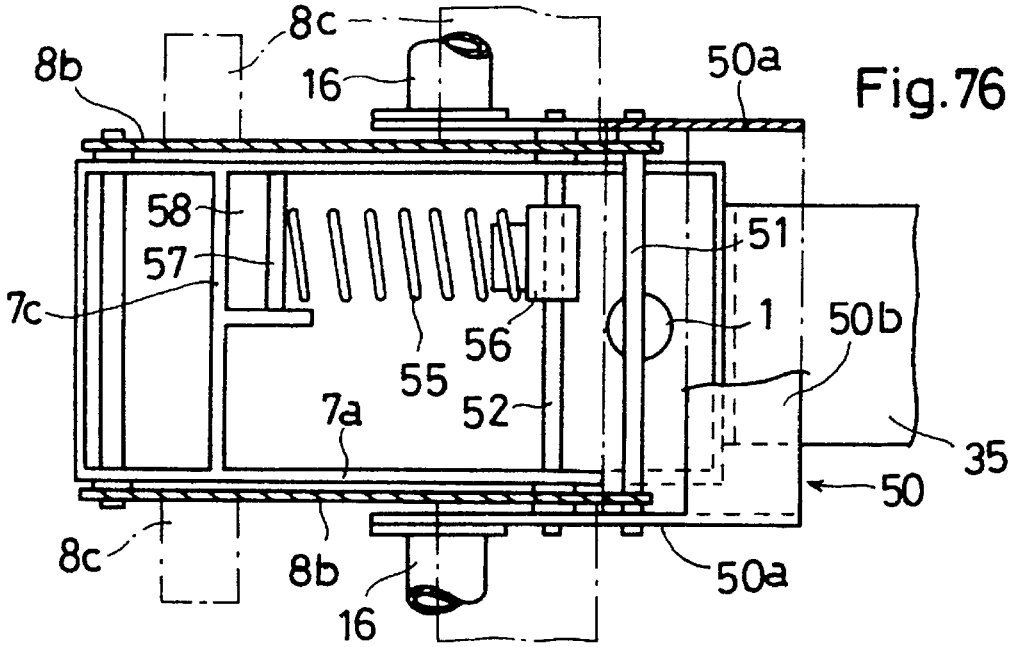
FIG. 76 is a sectional plan view taken along lines 76—76 in FIG. 75.

The wedge member 58 is vertically movable by turning an adjusting knob 59 (FIG. 75). Thus, by operating the adjusting knob 59, it is possible to adjust the elastic force of the tilting control coil spring 55. The initial elastic force of the coil spring 55 should be set so that the coil spring 55 starts deforming only when the seat occupant reclines on the unillustrated seat back. Of course, two such springs may be arranged in side by side relation.

The unillustrated seat back together with other components associated therewith may be configured in the same manner as in the foregoing embodiments (see FIGS. 26, 40 and 54 for example), thereby providing comfortable rocking for the seat occupant.

Figure 77:
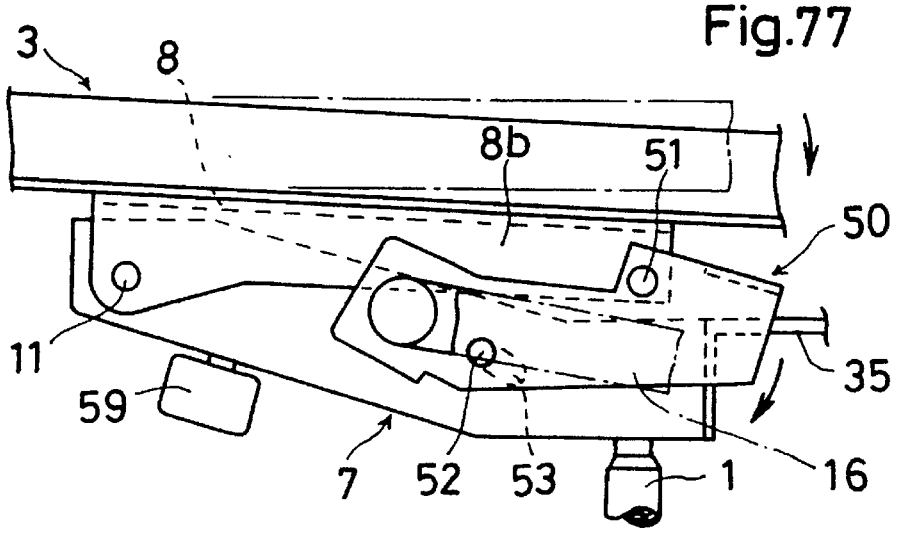
FIG. 77 is a side view similar to FIG. 75 but showing the same chair in operation for tilting.

According to the twentieth embodiment described above, when the user reclines on the unillustrated seat back, the carrier plate 8 together with the seat 3 carried thereby pivots downward about the first pivot shaft 11 while the pivotal frame 50 also pivots rearwardly downward about the second pivot shaft 51. At this time, the guide shaft 52 slides upwardly forward along each guide slot 53 against the tilting control coil spring 55, as shown in FIG. 77. Apparently, since the second pivot shaft 51 is supported by the carrier plate 8 which itself is pivotable downward, the pivotal movement of the carrier plate 8 is also utilized for tilting the seat back, thereby increasing the tilting range of the seat back. Further, the twentieth embodiment is also advantageous in that the support structure as a whole is greatly simplified in comparison with the foregoing embodiments, requiring a smaller number of components.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

We claim:

1. A chair comprising:

a support structure;

a seat supported on the support structure;

a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind, the control means being pivotally connected to the support structure to be tiltable rearward;

wherein the chair further comprises means for preventing the control means from tilting rearward until the seat back tilts rearward up to a predetermined intermediate inclination angle but for allowing the control means to tilt rearward when the seat back tilts rearward beyond the predetermined intermediate inclination angle.

2. The chair according to claim 1, wherein the waist supporting portion of the seat back is concave to be offset rearwardly from the back supporting portion before the seat back tilts rearward, the control means presses the waist supporting portion forward to straighten it when the seat back tilts rearward.

3. A chair comprising:

a support structure;

a seat supported on the support structure; and a seat back located behind the seat for tilting rearward against elastic means;

wherein the chair further comprises means for causing the seat to move rearward in response to rearward tilting of the seat back;

wherein the seat back comprises an upper back supporting portion which is substantially non-deformable, the seat back further comprising a lower waist supporting portion which is elastically deformable, the chair further comprising control means for pressing the waist supporting portion of the seat back forward when the seat back tilts rearward; and wherein the waist supporting portion of the seat back is concave to be offset rearwardly from the back supporting portion before the seat back tilts rearward, the control means pressing the waist supporting portion forward to straighten it when the seat back tilts rearward.

4. The chair according to claim 3, wherein the seat back comprises a downwardly open shell which includes an inner shell plate and an outer shell plate joined to the inner shell plate, the control means extending into the shell from below for pressing contact with the waist supporting portion.

5. A chair comprising:

a support structure;

a seat supported on the support structure;

a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind;

wherein the chair further comprises means for causing the control means to deform the waist supporting portion of the seat back forward relative to the back supporting portion when the seat back tilts rearward at least up to a predetermined intermediate inclination angle but for restraining forward deformation of the waist supporting portion when the seat back tilts rearward beyond the predetermined intermediate inclination angle; and wherein the waist supporting portion of the seat back is concave to be offset rearwardly from the back supporting portion before the seat back tilts rearward, the control means presses the waist supporting portion forward to straighten it when the seat back tilts rearward.

6. The chair according to claim 5, wherein the waist supporting portion of the seat back is forwardly concave to retreat rearward from the back supporting portion before the seat back tilts rearward, the control means extending along the waist supporting portion and having an upper end provided with at least one pressing roller in contact with the waist supporting portion from behind, the waist supporting portion being provided with at least one regulating roller for contact with the control means to prevent the waist supporting portion from excessively deforming forward relative to the back supporting portion, the waist supporting portion further being provided with at least one cam bulge for contact with the pressing roller, whereby the waist supporting portion of the seat back quickly deforms forward relative to the back supporting portion until the seat back tilts rearward up to the predetermined intermediate inclination angle, whereas forward deformation of the waist supporting portion is at least retarded when the seat back tilts rearward beyond the predetermined intermediate inclination angle.

7. The chair according to claim 5, further comprising means for causing the seat to move rearward in response to rearward tilting of the seat back.

8. The chair according to claim 5, wherein the control means is a control plate fixed to the support structure.

9. A chair comprising:

a support structure;

a seat supported on the support structure;

a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind;

wherein the chair further comprises means for causing the control means to deform the waist supporting portion of the seat back forward relative to the back supporting portion by a greater amount at widthwise outer positions of the waist supporting portion than at a widthwise center position when the seat back tilts rearward.

10. The chair according to claim 9, wherein the waist supporting portion of the seat back has a central section and a pair of side sections separate from the central section, the central section is provided with a rearwardly directed cam bulge having a smaller height, each of the side sections being provided with a rearwardly directed cam bulge having a larger height, the control means obliquely extending rearwardly upward for pressing contact with the respective cam bulges, each of the central and side sections being provided with distance regulating means for preventing excessive forward deformation of the respective sections.

11. The chair according to claim 10, wherein the distance regulating means is a regulating roller.

12. A chair comprising:

a support structure;

a seat supported on the support structure;

a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind, the control means being tiltable rearward;

wherein the chair further comprises means for preventing the control means from tilting rearward until the seat back tilts rearward up to a predetermined intermediate inclination angle but for allowing the control means to tilt rearward when the seat back tilts rearward beyond the predetermined intermediate inclination angle; and wherein the waist supporting portion of the seat back is concave to be offset rearwardly from the back supporting portion before the seat back tilts rearward, the control means presses the waist supporting portion forward to straighten it when the seat back tilts rearward.

13. A chair comprising:

a support structure;

a seat supported on the support structure;

a seat back located behind the seat for tilting rearward against elastic means, the seat back having an upper back supporting portion, the seat back further having a lower waist supporting portion which is elastically deformable forward relative to the back supporting portion; and control means held in pressing contact with the waist supporting portion of the seat back from behind;

wherein the chair further comprises means for causing the control means to deform the waist supporting portion of the seat back forward relative to the back supporting portion when the seat back tilts rearward at least up to a predetermined intermediate inclination angle but for restraining forward deformation of the waist supporting portion when the seat back tilts rearward beyond the predetermined intermediate inclination angle; and wherein the waist supporting portion of the seat back is concave to be offset rearwardly from the back supporting portion before the seat back tilts rearward, the control means extending along the waist supporting portion and having an upper end provided with at least one pressing roller in contact with the waist supporting portion from behind, the waist supporting portion being provided with at least one regulating roller for contact with the control means to prevent the waist supporting portion from excessively deforming forward relative to the back supporting portion, the waist supporting portion further being provided with at least one cam bulge for contact with the pressing roller, whereby the waist supporting portion of the seat back quickly deforms forward relative to the back supporting portion until the seat back tilts rearward up to the predetermined intermediate inclination angle, whereas forward deformation of the waist supporting portion is at least retarded when the seat back tilts rearward beyond the predetermined intermediate inclination angle.

* * * * *